US006986574B2

(12) United States Patent
Nojima et al.

(10) Patent No.: US 6,986,574 B2
(45) Date of Patent: Jan. 17, 2006

(54) RECORDING APPARATUS

(75) Inventors: Takashi Nojima, Tokyo (JP); Shoshi Kikkawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 10/762,322

(22) Filed: Jan. 23, 2004

(65) Prior Publication Data

US 2004/0150703 A1 Aug. 5, 2004

(30) Foreign Application Priority Data

Jan. 31, 2003 (JP) ..... 2003-023995

(51) Int. Cl.
*B41J 13/00* (2006.01)

(52) U.S. Cl. ..... 347/104; 400/642; 400/647.1; 271/314

(58) Field of Classification Search ..... 347/104; 400/649, 653, 642, 647.1; 271/264, 314
See application file for complete search history.

(56) References Cited

U.S. PATENT DOCUMENTS 4,184,780 A * 1/1980 Kurihara et al. ..... 400/56
4,729,557 A * 3/1988 Kiyohara ..... 271/272
5,372,443 A * 12/1994 Borucki, Jr. et al. ..... 400/649
5,506,606 A 4/1996 Saikawa et al. ..... 346/134
5,515,094 A * 5/1996 Tanaka et al. ..... 347/104
5,847,719 A 12/1998 Yamaguchi et al. ..... 346/134
6,213,464 B1 4/2001 Inoue et al. ..... 271/248
6,471,428 B2 10/2002 Iwasaki et al. ..... 400/582
6,567,187 B1 5/2003 Iwasaki et al. ..... 358/296

FOREIGN PATENT DOCUMENTS

JP 04298450 A * 10/1992

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

A recording apparatus with a relatively simple structure for easily, reliably, and stably transporting a recording medium includes a recording head performing a recording operation by discharging ink; a platen for guiding the recording medium, disposed so as to face the recording head; a discharge roller for discharging the recording medium, disposed in the downstream region of the platen and comprising at least two first roll portions and at least one second roll portion having a smaller diameter than the first roll portions; and at least two discharge guides for guiding the recording medium from the platen to the discharge roller. One end of each of the discharge guides is rotatably supported by the platen, and the other end thereof abuts against the second roll portion of the discharge roller.

18 Claims, 22 Drawing Sheets

1

RECORDING APPARATUS

BACKGROUND OF THE INVENTION

1. Field of the Invention

The present invention relates to a recording apparatus for recording a character, an image, and/or the like by discharging ink onto a recording medium such as a recording sheet, and more particularly, it relates to a recording apparatus including guide members for guiding a recording medium to a discharge roller.

2. Description of the Related Art

Commercially available recording apparatuses performing a recording operation on a recording medium such as a recording sheet or a sheet for an overhead projector (OHP) have a variety of recording heads mounted thereon, including those of a wire dot type, a thermal type, a thermal transfer type, and an inkjet type. In particular, a recording head of an inkjet type is known as a recording component whose operational cost is inexpensive and which operates with a relatively low noise level since it directly discharges ink onto a recording medium.

FIG. 20 is a perspective view of a known inkjet printer (hereinafter, referred to simply as a printer). For the sake of easy understanding, a part of an outer casing of the printer is omitted. Also, FIG. 21 is a sectional view of the known printer, while a part thereof unnecessary for explanation is omitted.

As shown in FIGS. 20 and 21, the known printer includes a recording unit 100, including a carriage 101 having a recording head mounted thereon, for recording an image and/or the like on a recording medium; an automatic feed unit 102 for feeding a recording medium; a transport unit 103 for transporting the recording medium to the recording unit 100 in the arrow T direction indicated in FIGS. 20 and 21; and a discharge unit 105 for discharging the recording medium having a recording operation performed thereon by the recording unit 100.

When the printer receives a recording signal, a plurality of recording media stacked in the automatic feed unit 102 are individually separated by separation means (not shown) and are transported sheet by sheet.

At the transport unit 103, a recording medium is transported by a transport roller 106 and a transport pinch roller 107. When the transport unit 103 transports a recording medium by a length corresponding to a recording width of the recording head, the printer causes the carriage 101 to sweep and sequentially performs a recording operation on the recording surface of the recording medium by driving and controlling the recording head in accordance with a recording signal. The recording unit has a platen for guiding the other side of the recording surface of the recording medium. After completion of the recording operation, the recording medium is transported to the discharge unit 105.

As shown in FIG. 21, the transport unit 103 includes the transport roller 106 and the transport pinch roller 107. The transport roller 106 has a coating material containing ceramic particles applied on the surface thereof and transports a recording medium with a friction generated between the recording medium and the transport roller 106 by pressing the recording medium with the transport pinch roller 107. The transport roller 106 has a platen 112 disposed downstream therefrom for guiding a part of the recording medium facing the recording head mounted on the carriage 101.

The platen 112 has a set of a first discharge roller 108 and a first discharge pinch roller 109 and a set of a second discharge roller 110 and a second discharge pinch roller 111, all disposed in the downstream region thereof along the arrow T direction serving as a transport direction of the recording medium. The transport surface of each of the first and second discharge rollers 108 and 110 is composed of a high-friction material such as rubber having a relatively large coefficient of friction. The first and second discharge pinch rollers 109 and 111 are disposed so as to be pressed towards the first and second discharge rollers 108 and 110, respectively.

FIG. 22 is a partial sectional view of the printer, illustrating a state in which a recording medium 113 is traveling in the vicinity of the first discharge roller 108. A relative position between the platen 112 and the first discharge roller 108 in the height or vertical direction is set such that the top part of the peripheral surface of the first discharge roller 108 lies slightly higher than the recording-medium guiding-surface of the platen 112. When the platen 112 lies higher than the top part of the first discharge roller 108, a pressing force of the first discharge pinch roller 109 decreases due to elasticity of a recording medium, thereby deteriorating a discharge performance. Since the relative position between the platen 112 and the first discharge roller 108 in the height direction is set such that the top part of the peripheral surface of the first discharge roller 108 lies slightly higher than the recording-medium guiding-surface of the platen 112, the recording medium 113 guided by the platen 112 abuts first against the first discharge roller 108.

The transport speed of the first discharge roller 108 is arranged so as to rotate at nearly the same speed as that of the transport roller 106. When the transport speed of the first discharge roller 108 is lower than that of the transport roller 106, a recording sheet is sometimes deformed at the recording unit. As a countermeasure against this problem, taking tolerances and other characteristics of the discharge roller and the transport roller into account, in general, the former is often designed so as to rotate slightly higher than the latter. Here, the circumferential speed of the peripheral surface of the first discharge roller 108 is defined as VA. As shown in FIG. 22, when the leading edge of the recording medium 113 abuts against the first discharge roller 108, the speed of the recording medium 113 in the horizontal transport direction becomes VB, thereby resulting in being slightly lower than the original design speed VA.

Hence, during a transitional period of the leading edge of the recording medium 113 being introduced to the first discharge roller 108, the traveling speed of the recording medium 113 is sometimes slightly altered.

Since the recording head of an inkjet type is used performing a recording operation by ejecting ink droplets onto the recording surface of a recording medium, the recording operation is performed in a non-contact state between the recording medium and the recording head. A decrease in speed of an ink droplet due to an air drag and the like during ejection toward the recording medium sometimes causes the ink droplet to fly in a different direction from the originally designed one. In order to solve this problem, it is preferable that the recording medium and the recording head lie close to each other, and hence the distance therebetween is generally set in the range from 0.5 mm to 1.5 mm.

Meanwhile, a variety of recording media including from a sheet of relatively thin normal paper to a relatively thick envelope are used. When a relatively thick recording medium is used, it is expected that the recording head and the recording medium come into contact with each other. In order to avoid such a contact, many printers have a structure in which an operator can adjust the distance between the platen for supporting the recording medium and the recording head in accordance with the thickness of a recording medium. A carriage moving method and a platen moving method are known methods for adjusting the distance between the platen and the recording head.

As shown in FIG. 22, when the platen moving method is employed, since the abutment position between the leading edge of the recording medium 113 and the first discharge roller 108 lies below the top of the peripheral surface of the first discharge roller 108, the speed VB of the recording medium becomes lower than VA, thereby leading to an increase in so-called printing irregularity.

SUMMARY OF THE INVENTION

The present invention can provide a recording apparatus having a relatively simple structure for easily, reliably, and stably transporting a recording medium toward a discharge roller.

A recording apparatus according to the present invention can include a recording head performing a recording operation by discharging ink; a platen for guiding the recording medium, disposed so as to face the recording head; a discharge roller for discharging the recording medium, disposed downstream of the platen and comprising at least two first roller portions and at least one second roller portion having a smaller diameter than the first roller portions; and at least two discharge guides for guiding the recording medium from the platen to the discharge roller. One end of each of the discharge guides is rotatably supported by the platen, and the other end thereof abuts against the second roller portion of the discharge roller.

The recording apparatus having the above structure according to the present invention can be equipped with the guide members, each having one end rotatably supported by the platen and the other end abutting against the second roller portion of the discharge roller, thereby eliminating so-called recording irregularity occurring upon abutment of the recording medium against the first roller portions of the discharge roller and thus achieving an accurate recording operation without decreasing the transport capacity of the discharge roller. Accordingly, the recording apparatus according to the present invention has a simple structure and also easily, reliably, and stably guides and transports a recording medium from the platen toward the discharge roller.

Further objects, features and advantages of the present invention will become apparent from the following description of the preferred embodiments with reference to the attached drawings.

DESCRIPTION OF THE PREFERRED EMBODIMENTS

An embodiment of the present invention will be described with reference to the attached drawings.

Figure 1:
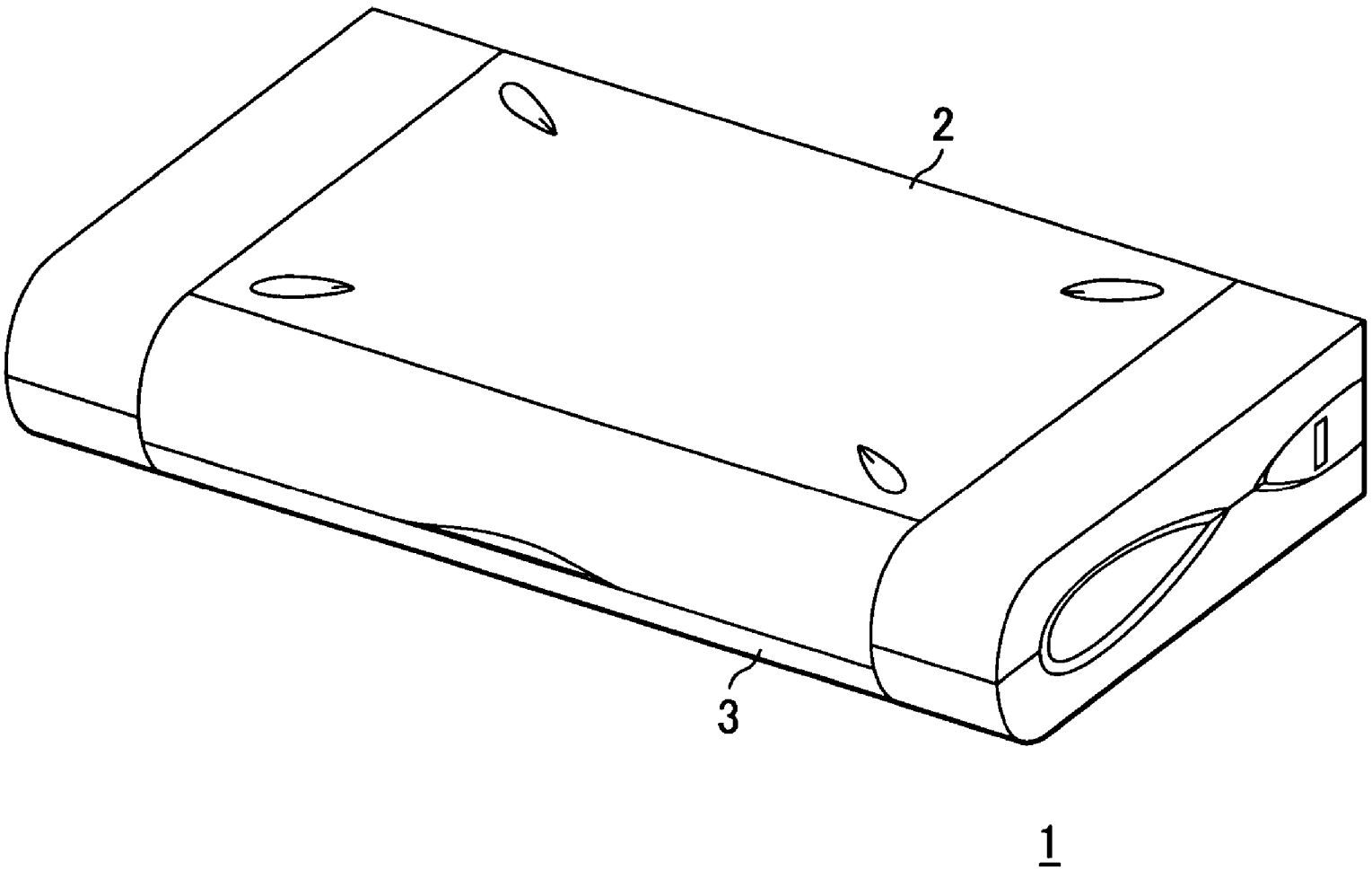
FIG. 1 is a perspective view of an inkjet printer housed in an outer casing, according to an embodiment of the present invention.

FIG. 1 is a perspective view of an inkjet printer according to the present embodiment, illustrating a non-operational state in which it is housed in an outer casing or being carried, for example.

As shown in FIG. 1, an inkjet printer 1 (hereinafter, referred to simply as a printer 1) includes an upper cover 2 and a discharge cover 3, both serving as a part of the outer casing.

Figure 2:
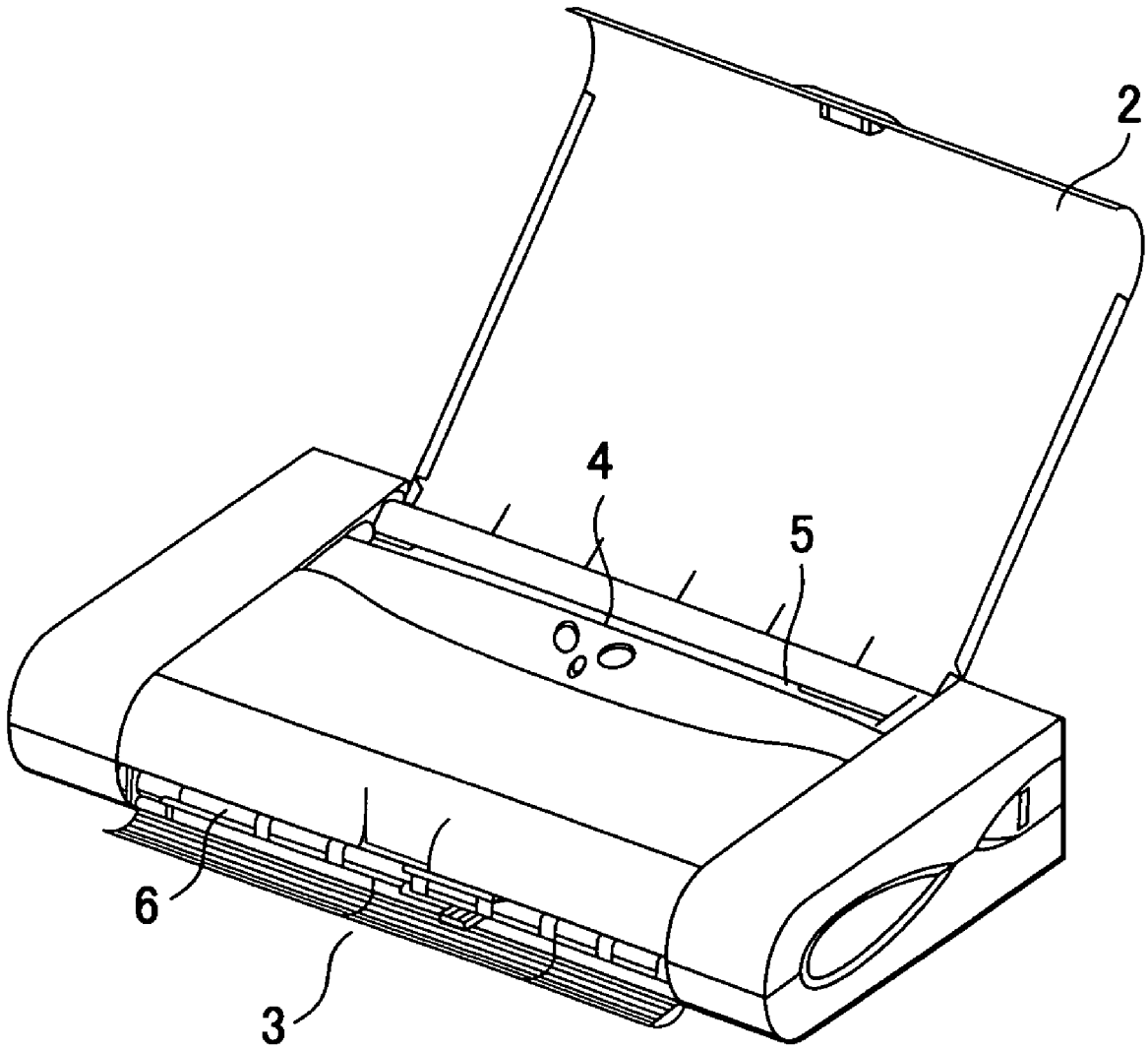
FIG. 2 is a perspective view of the printer, illustrating an operational state thereof.

FIG. 2 illustrates an operational state of the printer 1. As shown in FIG. 2, the printer 1 further includes a feed inlet 5 and an operation panel 4, which become usable by lifting the upper cover 2, and also includes a discharge outlet 6, which becomes usable as well by lowering the discharge cover 3.

Figure 3:
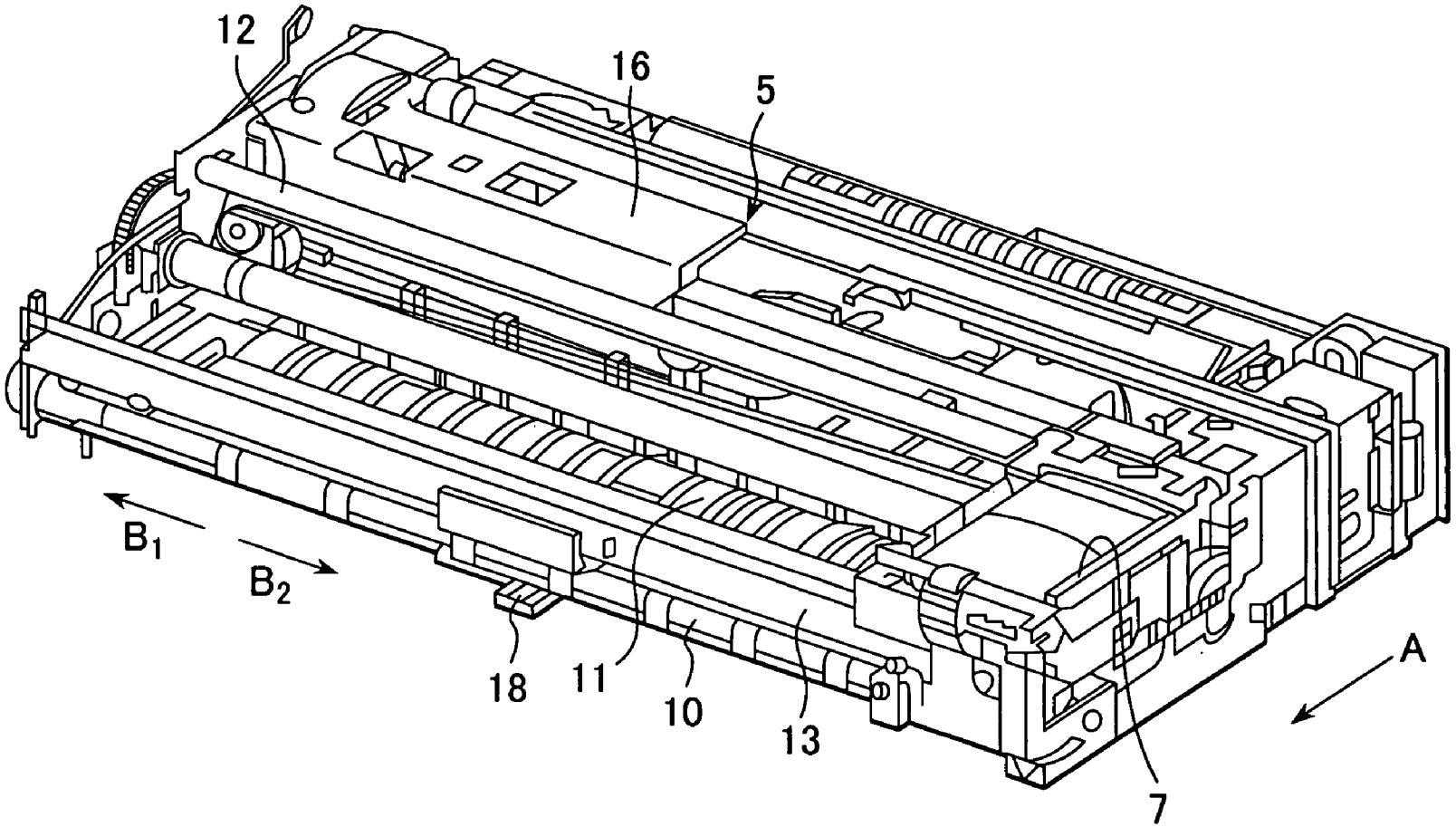
FIG. 3 is a perspective view of the internal structure of the printer.
Figure 15:
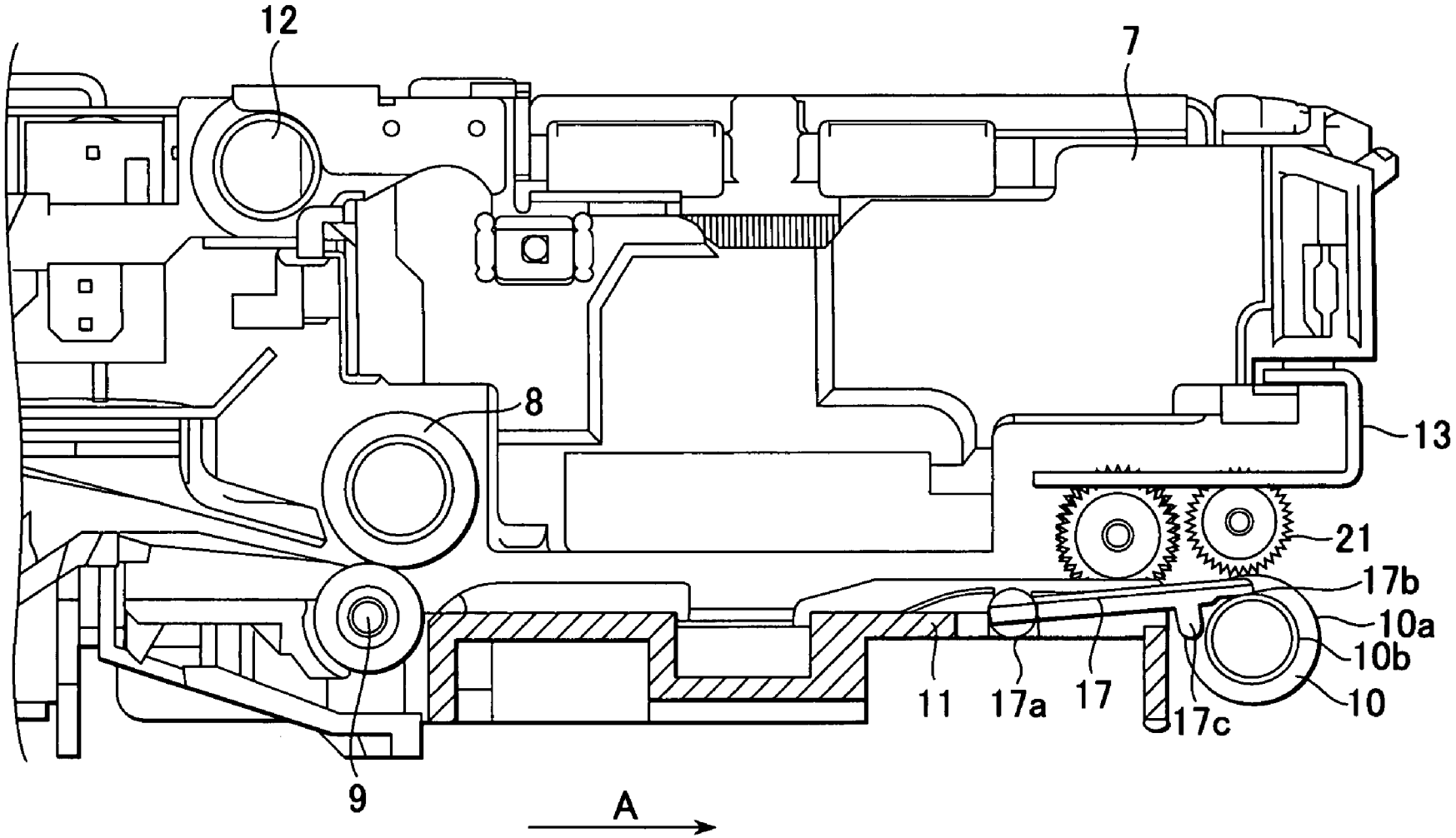
FIG. 15 is a partial sectional view of the printer, illustrating the operation of one of the discharge guides.
Figure 16:
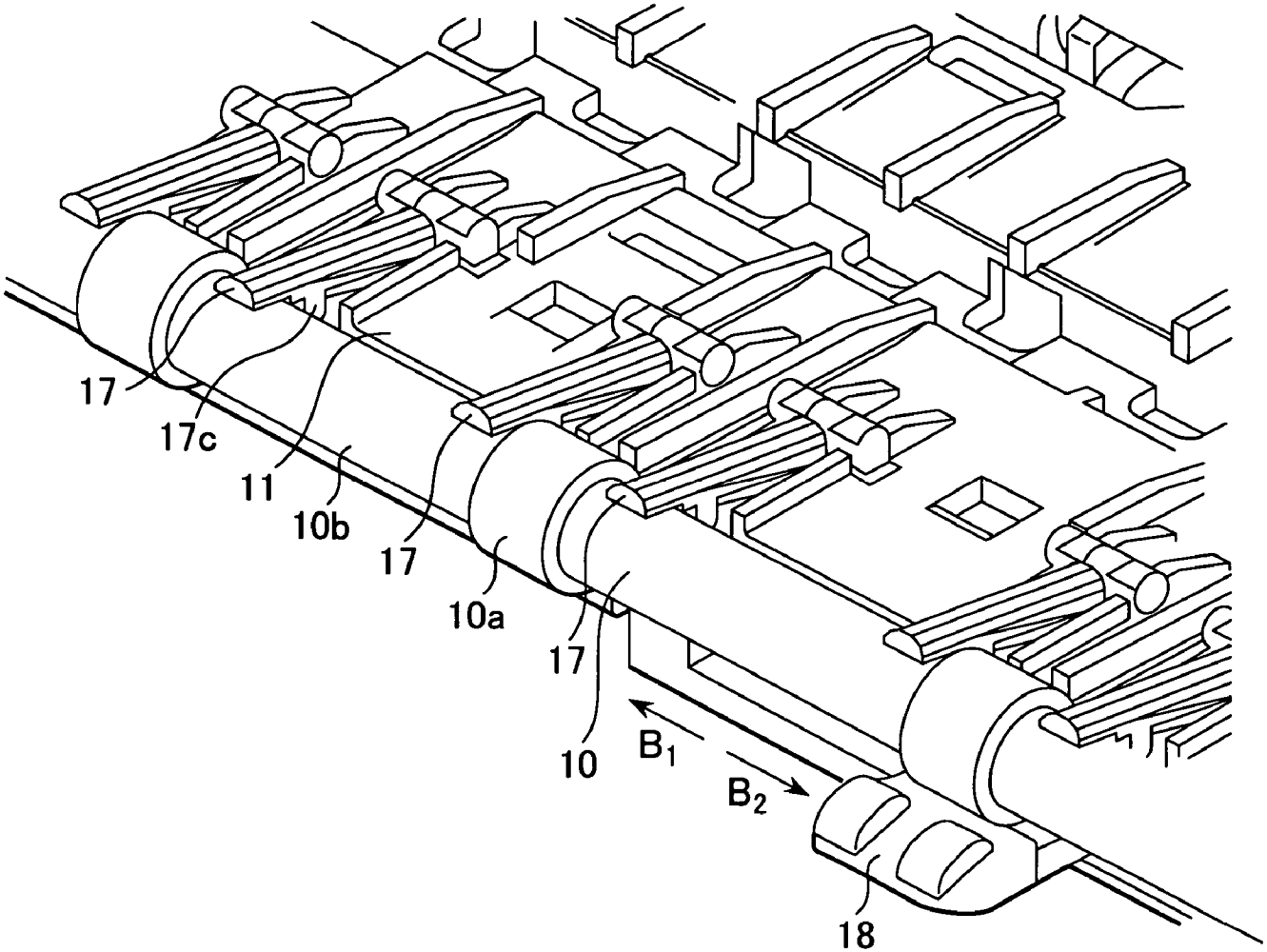
FIG. 16 is a partial perspective view of the printer, illustrating the operation of the discharge guides.

FIG. 3 is a perspective view of the printer 1 from which the outer casing is removed for illustrating the internal structure thereof. FIG. 15 is a partial sectional view of the printer 1. The feed inlet 5 has an automatic feed unit for feeding a recording medium disposed therein so as to individually separate stacked recording media and transport them sheet by sheet to a recording unit. A transport roller 8 (transporting means) has a coating material containing ceramic particles applied on the peripheral surface thereof for transporting a recording medium. The transport roller 8 has a plurality of transport pinch rollers 9 disposed so as to be pressed toward the transport roller 8 by springs (not shown). Since pressing forces of the transport pinch rollers 9 cause the transport roller 8 and a recording medium to have a friction produced therebetween, the printer 1 transports the recording medium in the arrow A direction indicated in FIG. 3 by rotating the transport roller 8. Although not shown in the figure, the transport roller 8 is driven to rotate by a transport motor via a line-feed (LF) gear train. While being guided by a platen 11, when the recording medium is transported to a position where it faces an inkjet recording head, it is temporarily halted there.

The inkjet recording head (hereinafter, referred to simply as recording head) is mounted on a carriage (holding means) 7. The carriage 7 is supported so as to be movable along a guide shaft 12 and a guide rail 13, both built in a chassis 16, in main sweeping or scanning directions shown by the arrows B1 and B2 indicated in FIG. 3 and is constrained by the guide rail 13 so as not to rotate about the guide shaft 12. In other words, the carriage 7 is guided by the guide shaft 12 and the guide rail 13 and is driven by a transfer motor (not shown) in the main sweeping directions.

The printer 1 causes the carriage 7 to sweep in accordance with a recording signal so as to perform a recording operation on a recording medium. The transport roller 8 is rotated by a certain angular amount for every performance of a recording operation, and again the printer 1 causes the carriage 7 to sweep in accordance with another recording signal so as to perform another recording operation on the recording medium. This operation is repeated one after another so as to perform plural recording operations on the recording medium. After the recording operations are finished, the recording medium is discharged outside the mechanical body of the printer 1 by a discharge roller (transport roller) 10 and a discharge pinch roller 21.

Figure 4:
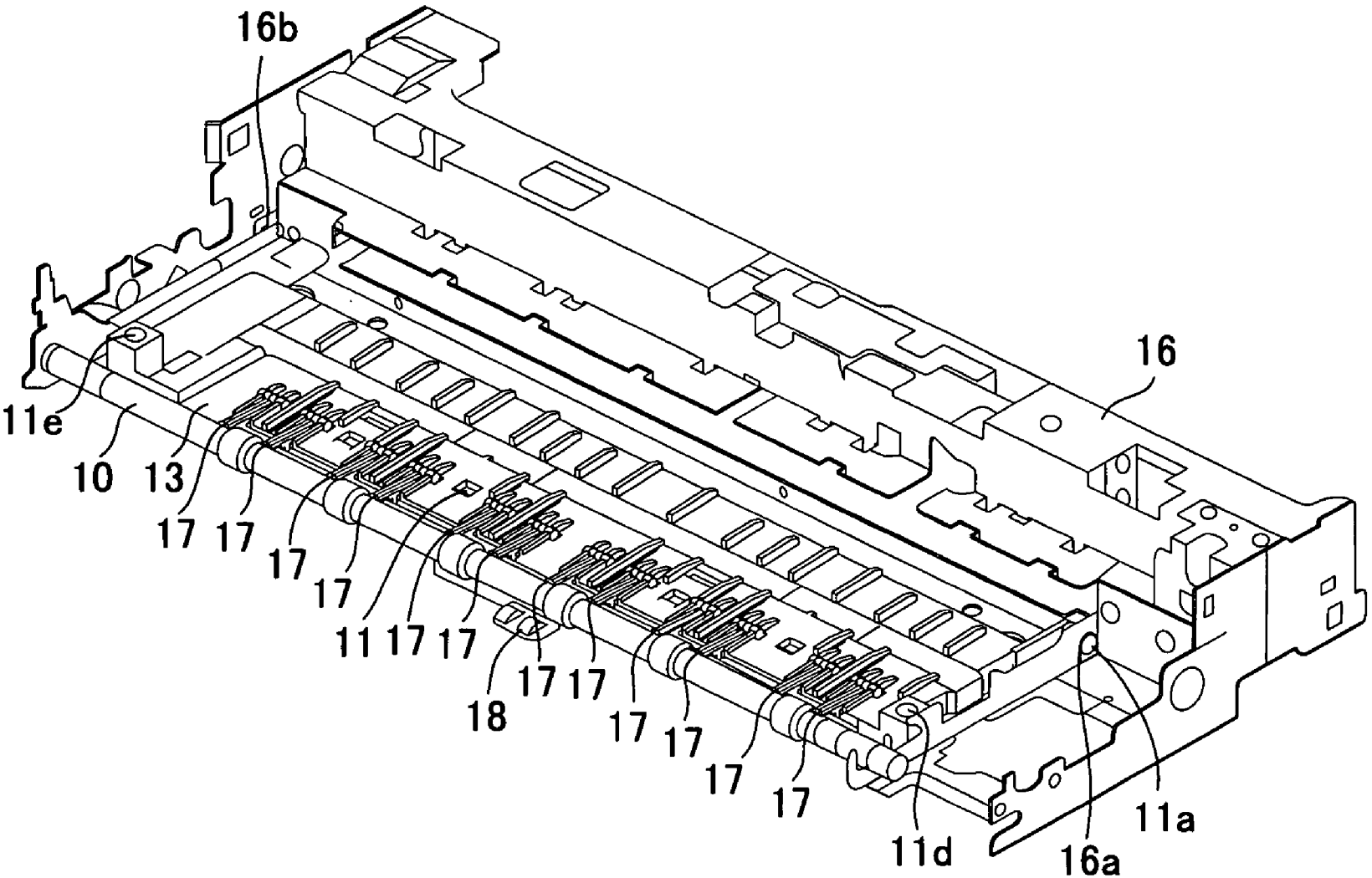
FIG. 4 is a perspective view of a platen and other components in the vicinity thereof.
Figure 5:
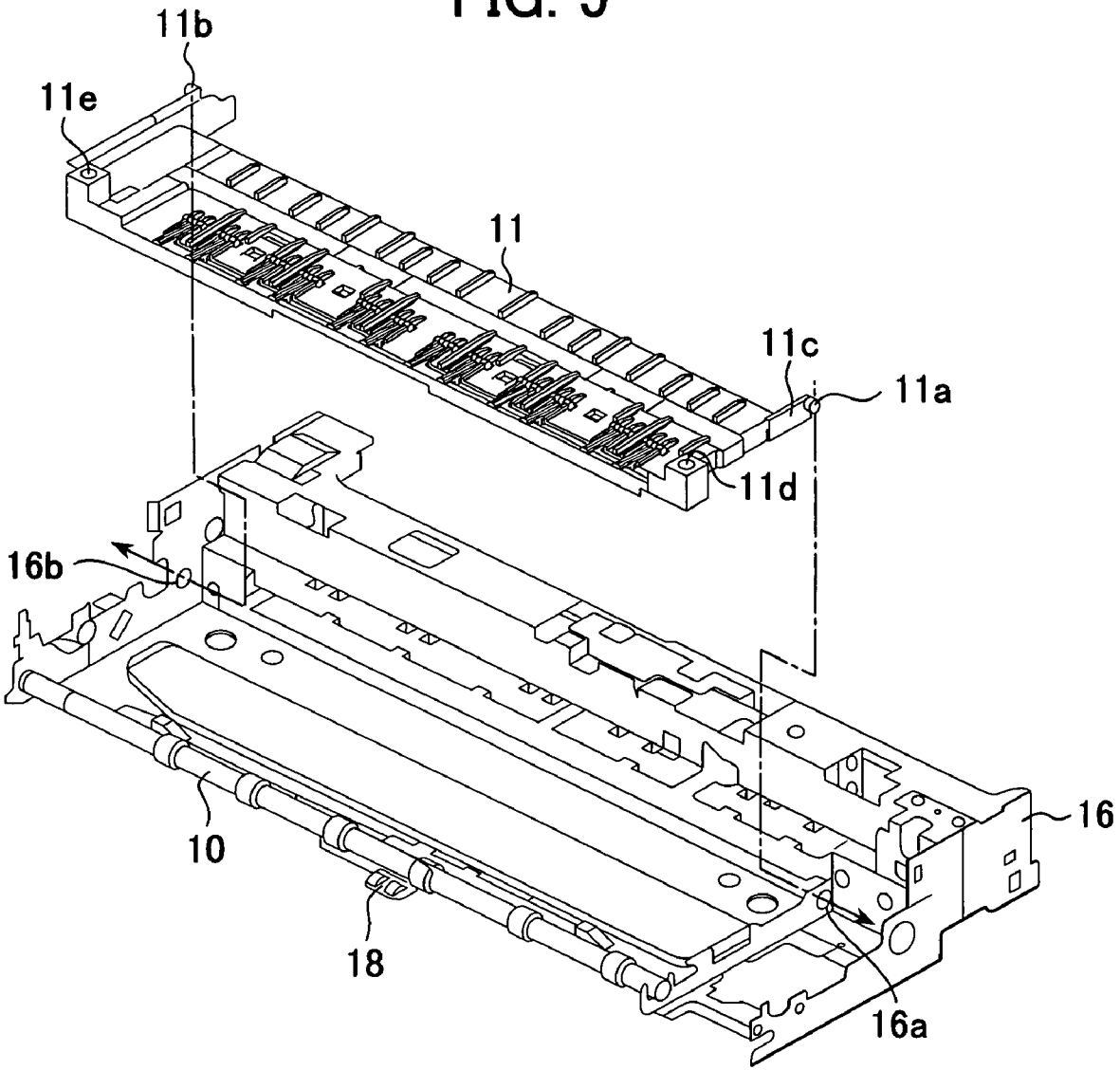
FIG. 5 is a partial perspective view of the printer, illustrating a state in which the platen is being fixed to a chassis.

FIG. 4 is a perspective view of the platen 11 and other components in the vicinity thereof. FIG. 5 is a partial perspective view of the printer 1, illustrating a state in which the platen 11 is being fixed to the chassis 16.

The platen 11 is journaled to the chassis 16 at two points thereof and has a plurality of discharge guides (guide members) 17 rotatably fixed thereto for guiding a recording medium from the platen 11 to the discharge roller 10.

As shown in FIGS. 4 and 5, the platen 11 has shaft portions 11*a* and 11*b* integrally formed therewith, which are inserted into and rotatably supported by support holes 16*a* and 16*b* of the chassis 16, respectively. The platen 11 also has an elastically deformable portion 11*c* integrally formed therewith, which is elastically deformable when the shaft portion 11*a* of the platen 11 is inserted into the support hole 16*a* of the chassis 16.

The platen 11 is formed of a resin material such as an acrylonitrile-butadiene-styrene (ABS) plastic, and the elastically deformable portion 11*c* is formed so as to have example dimensions of about 2 mm thick, 7 mm wide, and 20 mm long. When the platen 11 is to be assembled into the chassis 16, the shaft portion 11*a* of the platen 11 is inserted into the support hole 16*a* of the chassis 16 by elastically deforming the elastically deformable portion 11*c* and is then released from the elastic deformation. Thus, the platen 11 is rotatably fixed to the chassis 16 via the shaft portions 11*a* and 11*b*.

The platen 11 further has bosses 11*d* and 11*e* disposed thereon so as to face the guide rail 13, for regulating its rotation about the shaft portions 11*a* and 11*b*, respectively. Accordingly, the platen 11 is rotatable between a first position where the bosses 11*d* and 11*e* abut against the guide rail 13 and a second position where the bosses 11*d* and 11*e* lie remote from the guide rail 13.

Figure 6:
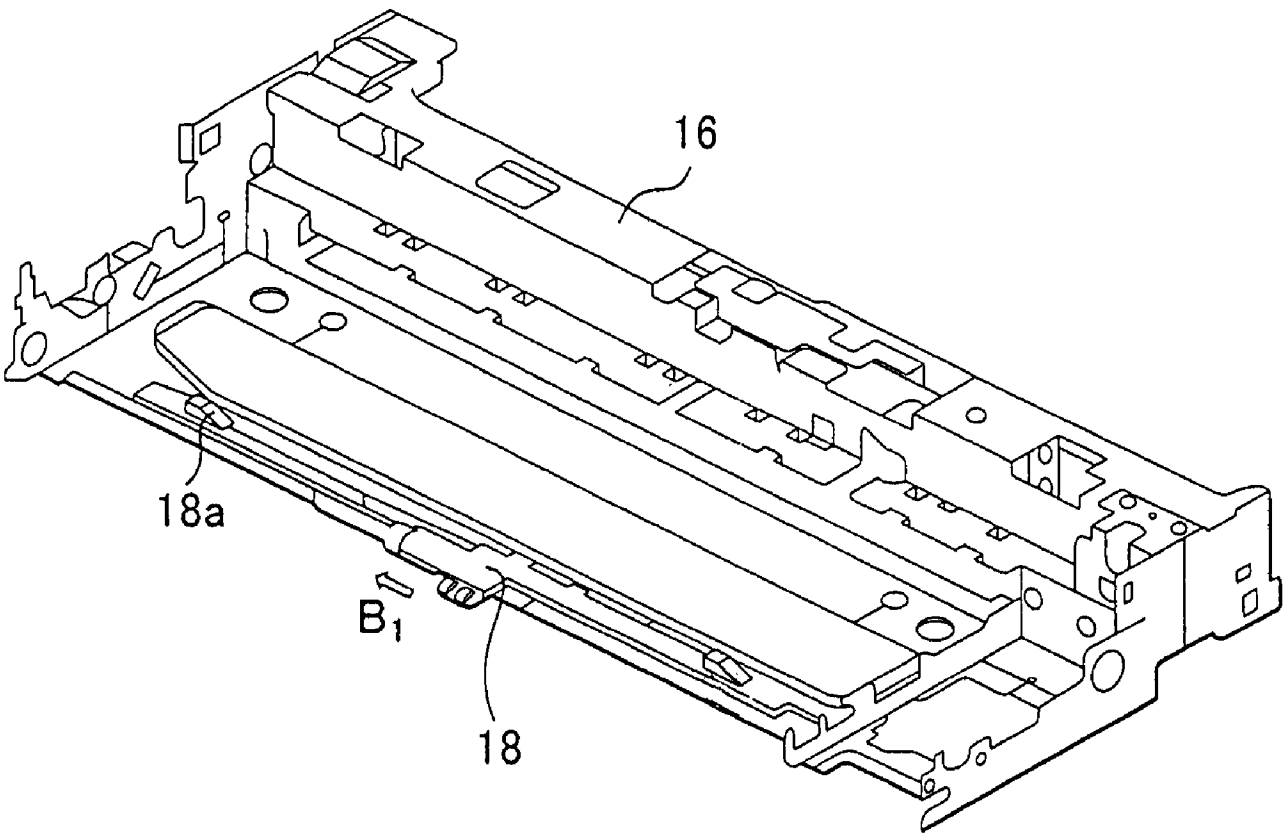
FIG. 6 is a partial perspective view of the printer, illustrating a sheet-distance adjusting method by rotating the platen.

An adjusting method for adjusting the distance between a recording medium and the recording head by rotating the platen 11 having the above-mentioned structure between the first and second positions will be described with reference to FIG. 6 illustrating a partial perspective view of the printer 1.

Since the recording head is used for performing a recording operation by ejecting ink droplets onto the recording surface of the recording medium, the recording operation is performed in a non-contact state between the recording medium and the recording head. A decrease in speed of an ink droplet due to air drag and the like during ejection toward the recording medium sometimes causes the ink droplet to fly in a different direction from the originally designed direction. In order to solve this problem, it is preferable that the recording medium and the recording head lie close to each other, and hence the distance therebetween is generally set in the range from 0.5 mm to 1.5 mm.

Meanwhile, a variety of recording media, ranging from relatively thin normal paper to relatively thick envelopes, is used. When a relatively thick recording medium is used, it is expected that the recording head and the recording medium come into contact with each other. In order to avoid this contact, many printers have a structure in which an operator can adjust the distance between the platen and the recording head in accordance with the thickness of a recording medium. A carriage moving method and a platen moving method are known adjusting methods for adjusting the distance between the platen and the recording head. In the present embodiment, the platen moving method is employed. Hereinafter, the distance between a recording medium (recording sheet) guided by the platen and the recording head is referred to simply as the sheet distance.

The chassis 16 has sheet-distance adjusting lever 18 slidably fixed thereto, for adjusting the sheet distance.

Figure 7:
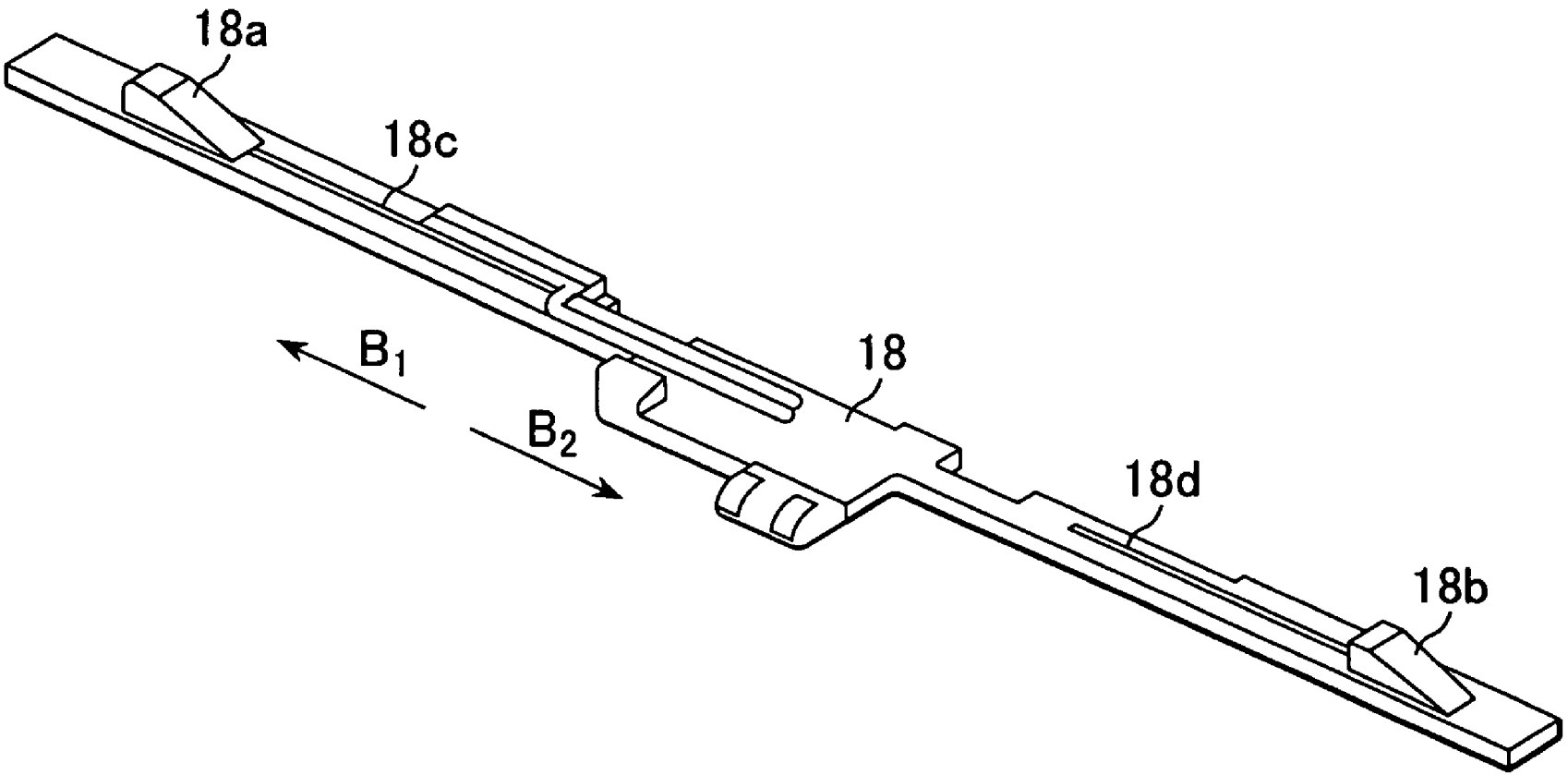
FIG. 7 is a perspective view of a sheet-distance adjusting lever.

FIG. 7 is a perspective view of the sheet-distance adjusting lever 18. As shown in FIG. 7, the sheet-distance adjusting lever 18 has linear grooves 18*c* and 18*d* disposed along the longitudinal direction thereof, and the widths of the grooves 18*c* and 18*d* are set so as to allow bent portions (not shown) of the chassis 16 to be inserted thereinto. Since the bent portions of the chassis 16 are engaged in the grooves 18*c* and 18*d*, the sheet-distance adjusting lever 18 is guided along the arrow B1 and B2 directions indicated in FIG. 6 with respect to the chassis 16.

The sheet-distance adjusting lever 18 also has cams 18*a* and 18*b*, each having a sloped surface, disposed adjacent to ends of the grooves 18*c* and 18*d*, respectively.

Figure 12:
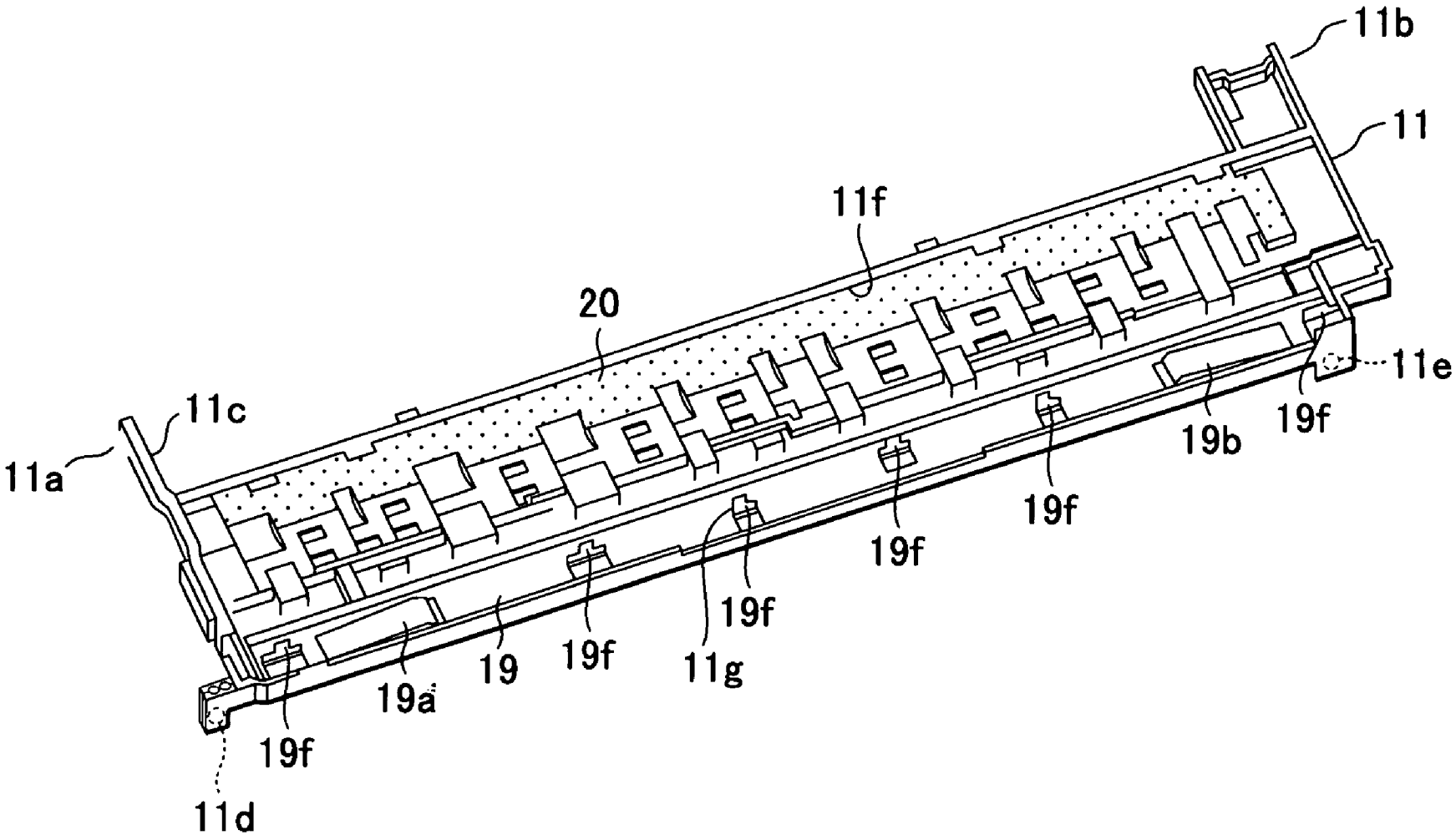
FIG. 12 is a perspective view of the platen.
Figure 13:
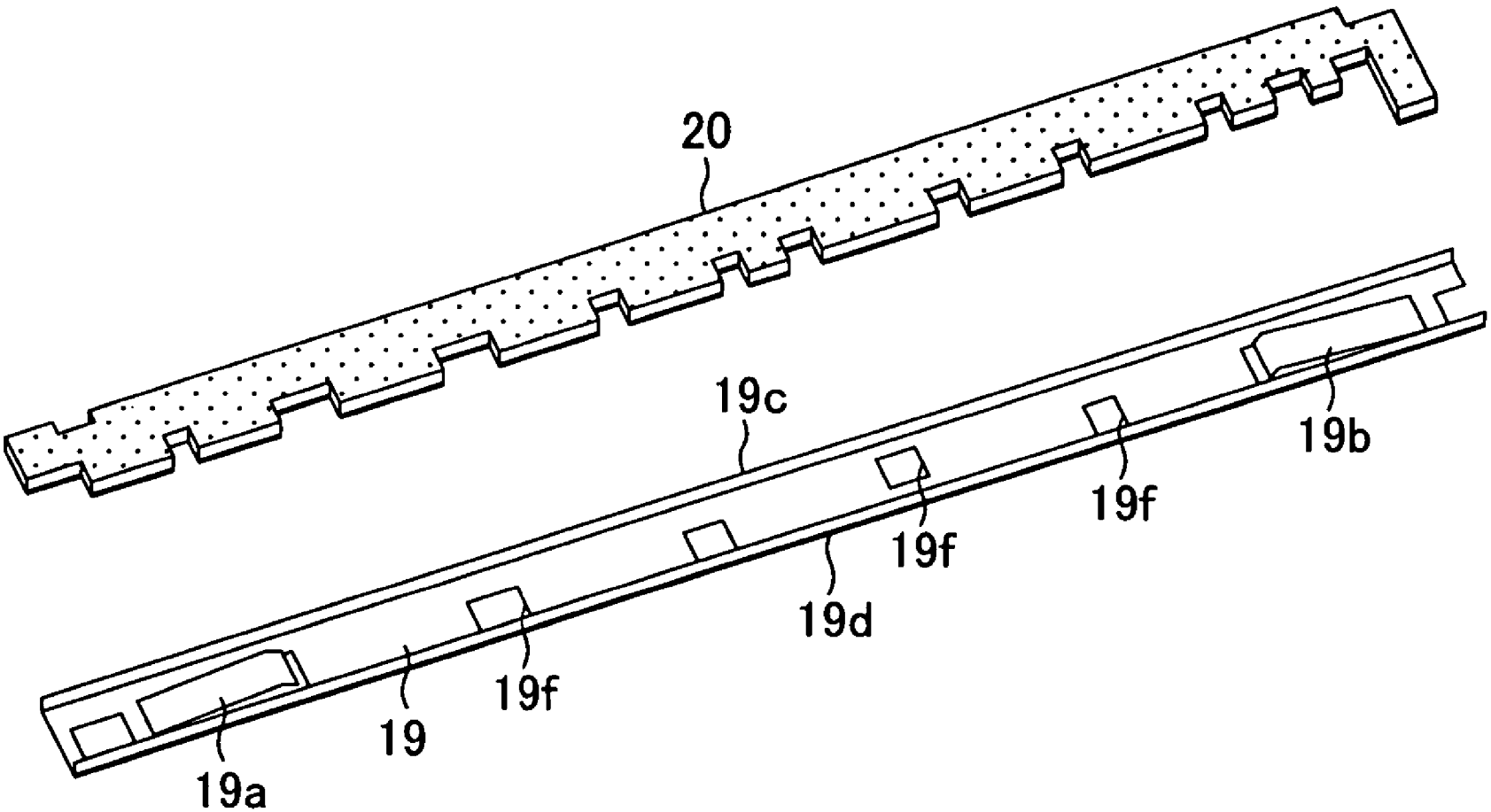
FIG. 13 is a perspective view of a leaf spring and an ink absorber.

FIGS. 12 and 13 are perspective views of the rear side of the platen 11 and components fixed to the platen 11, respectively.

As shown in FIGS. 12 and 13, the platen 11 further has a depression 11*f* disposed in the rear surface thereof so as to face a region where the recording head is movable. The depression 11*f* has an ink absorber 20 disposed therein for collecting ink which does not land within the peripheries of a recording medium on which a marginless recording operation is performed. The ink absorber 20 is composed of, for example, a sufficiently-absorbent porous material.

By performing the recording operation over a part of the depression 11*f* extending slightly out from the edge of the recording medium, the printer 1 allows the recording medium to be recorded without leaving a margin along the edge thereof. Taking a degree of cutting accuracy of recording media at the time of manufacturing and a degree of transporting accuracy of the printer 1 into account, a distance of the part of the depression 11*f* extending out from the edge of the recording medium is set in a range from about 1 mm to 5 mm.

The platen 11 further has a leaf spring 19 fixed to the rear surface thereof such that the leaf spring 19 and the ink absorber 20 are disposed on opposite sides of the platen 11. The leaf spring 19 has partially bent and raised spring portions 19*a* and 19*b* formed therein. Each of the spring portions 19*a* and 19*b* has dimensions of about 6 mm wide and 20 mm long, and the front thereof is bent so as to have a curved shape. The leaf spring 19 is composed of a spring-use stainless steel plate or the like and is subjected to low-temperature annealing after the bending process so as to remove residual stress during the bending process.

With a general molding method of a plastic component, the plastic component is completed in accordance with the steps of putting a resin material in a melted state at high temperatures, pouring it into a metal mold, cooling it down for solidification, and then releasing it from the metal mold. A resin material contracts by about 0.1% to 1% when it is cooled down for solidification. Hence, when the resin material is molded so as to provide a molded component having a non-uniform shape or an uneven thickness, it contracts unevenly, thereby sometimes causing a deformation such as a warp.

Since the platen 11 according to the present embodiment has a shape close to a flat plate, it is likely warped when molded. As a countermeasure against this problem, the leaf spring 19 has a substantially uniform width along the longitudinal direction of the platen 11 and engages with the platen 11 so as to be integrally fixed to the same. The leaf spring 19 also has a plurality of engaging holes 19*f* disposed at a certain spacing along the longitudinal direction thereof so as to engage with the platen 11. Also, the platen 11 further has a plurality of engaging claws 11*g* integrally formed therewith on the rear side thereof so as to engage with the corresponding engaging holes 19*f* of the leaf spring 19.

The leaf spring 19 further has bent portions 19*c* and 19*d* formed along both side ends thereof extending parallel to the longitudinal direction thereof so as to have a large mechanical strength by increasing a modulus of section. The leaf spring 19 is afforded its necessary mechanical strength by bending a part of a flat plate, thereby making it lighter than a flat plate that achieves its necessary mechanical strength by an increase in thickness.

Also, the leaf spring 19 acts as a reinforcement member of the platen 11. As described above, by integrally fixing the leaf spring 19 to the platen 11, even when the platen 11 is formed by molding, a warp of the platen 11 is straightened by an urging force of the leaf spring 19. In addition, by integrally fixing the leaf spring 19 to the platen 11, the platen 11 is not required to attain the increased mechanical strength by itself, thereby making the platen 11 thinner. As a result, the platen 11 has a necessary mechanical strength without increasing the number of components, thereby achieving a compact and light structure of the overall printer 1 and reducing a manufacturing cost thereof.

A detailed operation of the platen 11 with the sheet-distance adjusting lever 18 will be described with reference to FIGS. 8 to 11, partial sectional views of the printer 1, each illustrating either of the cams 18*a* and 18*b* of the sheet-distance adjusting lever 18 and other components in the vicinity thereof.

Figure 8:
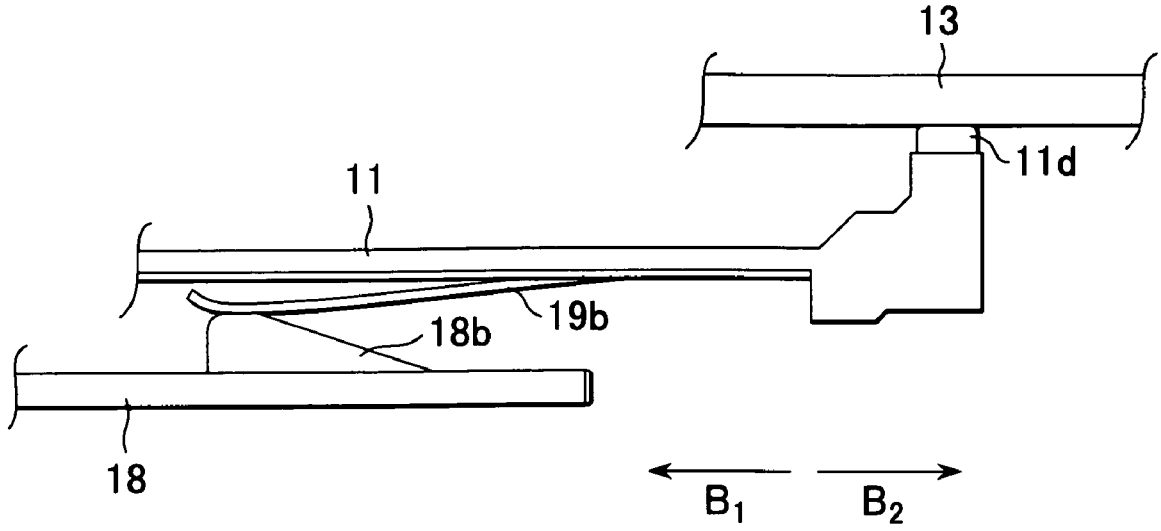
FIG. 8 is a partial side view of the printer, illustrating a detailed operation of the platen with the sheet-distance adjusting lever.
Figure 9:
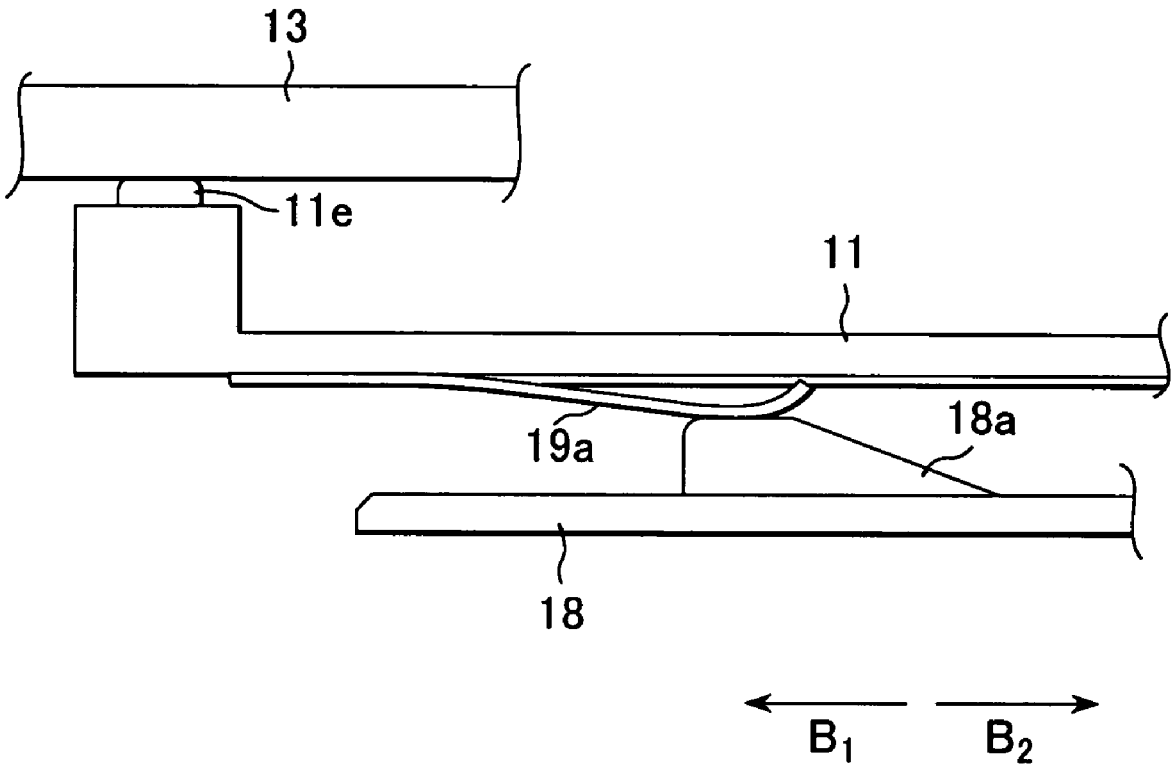
FIG. 9 is a partial side view of the printer, illustrating the detailed operation of the platen with the sheet-distance adjusting lever.

FIGS. 8 and 9 are the partial sectional views of the printer 1, illustrating a proximal state in which the sheet distance is set small. In the proximate state, the cam 18*b* of the sheet-distance adjusting lever 18 causes the spring portion 19*b* of the leaf spring 19 to be elastically deformed and compressed. The leaf spring 19 pushes up the platen 11 with an urging force of the spring portion 19*b*, thus causing the platen 11 to rotate about the shaft portions 11*a* and 11*b*.

As shown in FIG. 8, as the platen 11 rotates about the shaft portions 11*a* and 11*b*, the boss 11*d* abuts against the guide rail 13, whereby the rotation of the platen 11 is stopped at the first position. Since the guide rail 13 is a support member for supporting the carriage 7, a relative position between the carriage 7 and the platen 11 in the thickness direction of a recording medium is determined with only a single component of the guide rail 13 interposed therebetween, thereby accurately determining the sheet distance, that is, the distance between the recording medium guided by the platen 11 and the recording head mounted on the carriage 7.

Likewise, the cam 18*a* of the sheet-distance adjusting lever 18 causes the spring portion 19*a* of the leaf spring 19 to be compressed. The leaf spring 19 pushes up the platen 11 with its elastic force, thus causing the platen 11 to rotate about the shaft portions 11*a* and 11*b*. When the boss 11*e* abuts against the guide rail 13, the rotation of the platen 11 is stopped at the first position.

The leaf spring 19 is constructed such that urging forces of the spring portions 19*a* and 19*b* are greater than a load of the total weight of the platen 11, the leaf spring 19, a recording medium guided by the platen 11, the ink absorber 20 for achieving a recording operation without leaving a margin, and ink absorbed in the ink absorber 20, a repulsive force due to elasticity of the recording medium, and so forth so as to make the platen 11 rotatable.

Figure 10:
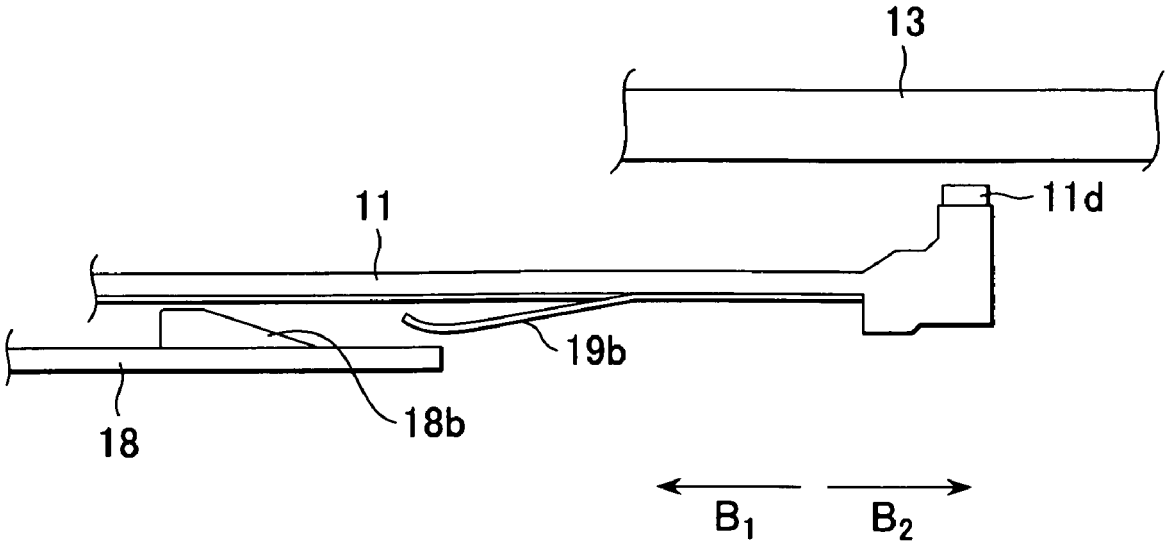
FIG. 10 is a partial side view of the printer, illustrating the detailed operation of the platen with the sheet-distance adjusting lever.
Figure 11:
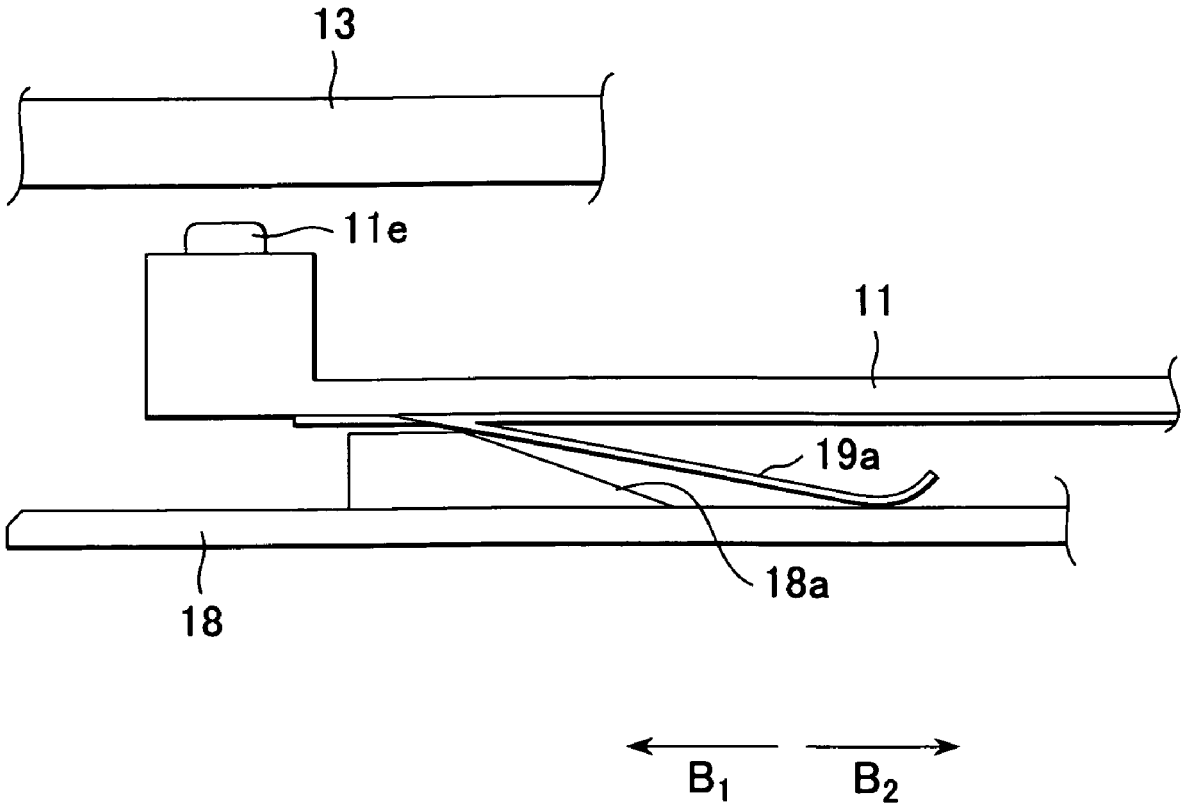
FIG. 11 is a partial side view of the printer, illustrating the detailed operation of the platen with the sheet-distance adjusting lever.

FIGS. 10 and 11 illustrate a remote state in which the sheet distance is set large. As the sheet-distance adjusting lever 18 is moved in the arrow B1 direction indicated in FIG. 6, the cam 18*b* is moved from directly underneath the spring portion 19*b*, and likewise the cam 18*a* is also moved from directly underneath the spring portion 19*a*. Since the platen 11 has no upward urging force of the spring portions 19*a* and 19*b* exerted thereon, it rotates downward due to its own weight about the shaft portions 11*a* and 11*b* and the rotation thereof is stopped at the second position when its stopper (not shown) abuts against the chassis 16. As a result, the platen 11 causes the recording head and the recording medium to be remote from each other so as to provide a large sheet distance.

An operation of the discharge guides 17 will be described with reference to FIGS. 14 to 17.

Figure 14:
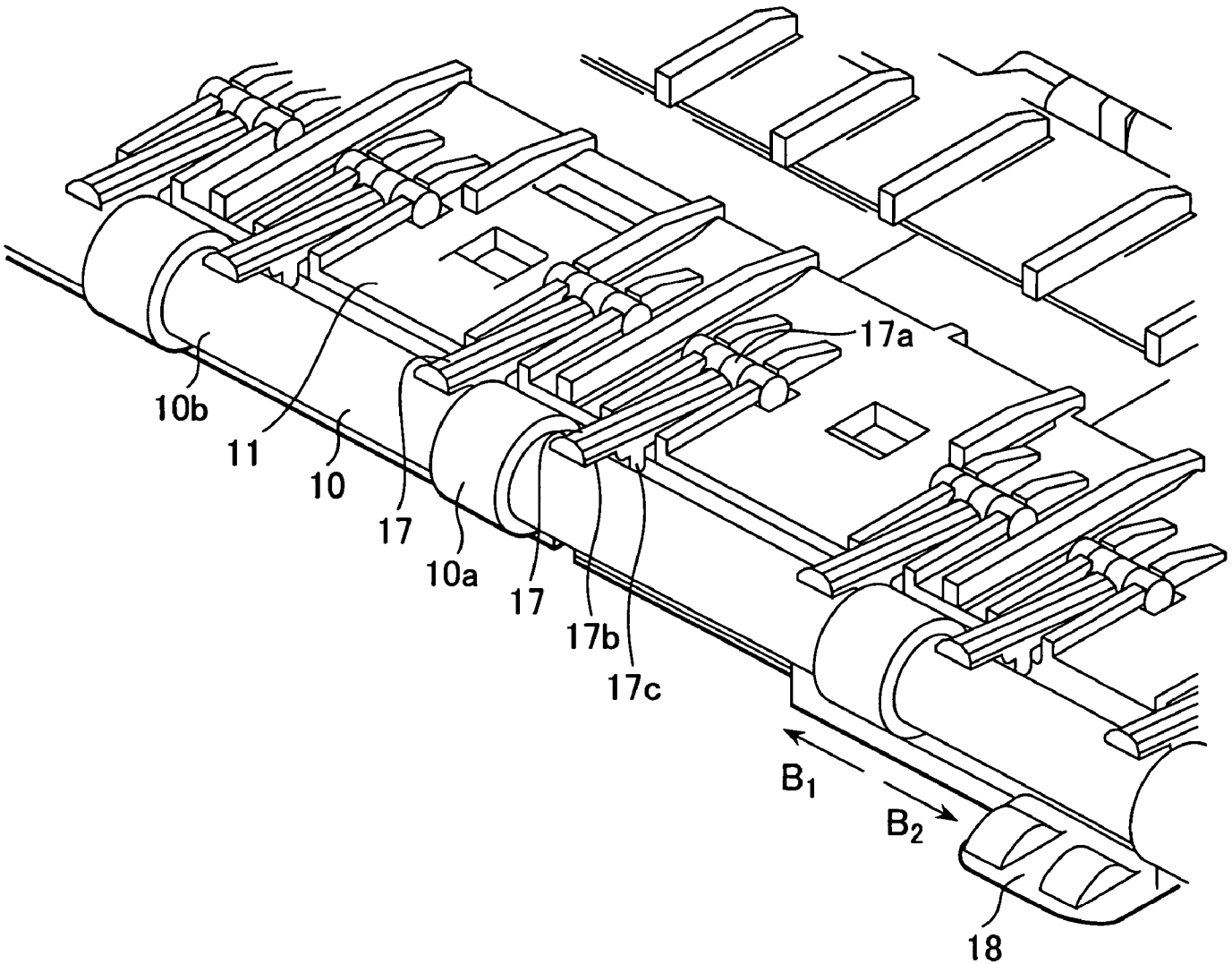
FIG. 14 is a partial perspective view of the printer, illustrating an operation of discharge guides.

FIG. 14 is a partial perspective view of the printer 1, illustrating the proximal state in which the sheet distance is set small. As shown in FIG. 14, the discharge roller 10 has pluralities of first and second roll or roller portions 10*a* and 10*b* alternately disposed at certain intervals along the axial direction thereof, and the second roll portions 10*b* are formed so as to have a smaller diameter than the first roll portions 10*a*.

The second roll portions 10*b* are formed by applying, for example, a nickel plating on the peripheral surface of a rotating shaft composed of a metal material and serve as "low-friction portions" having a smaller coefficient of friction than that of the first roll portions 10*a*. The first roll portions 10*a* are composed of an elastic material such as a rubber material, are disposed around the periphery of the rotating shaft, and serve as "high-friction portions" having a larger coefficient of friction than that of the second roll portions 10*b*. An example of the rubber material forming the first roll portions 10*a* is an ethylene-propylene diene monomer (EPDM), preferably having a rubber hardness of about 50° to 90°. Alternatively, the first roll portions 10*a* may be formed of a material having, for example, a urethane-base elastomer or a urethane coating material applied thereon, or a material such as a sponge having a relatively large coefficient of friction.

Each of the discharge guides 17 is composed of a resin material such as polyoxymethylene (POM) so as to provide a flat shape and has a support shaft (an upstream positioning portion or an upstream supporting portion) 17*a* integrally formed therewith at the rear end thereof in the transport direction of a recording medium so as to be rotatably supported by the platen 11. The discharge guide 17 also has an abutment (a downstream positioning portion or a downstream supporting portion) 17*b* formed at the front end thereof in the transport direction of the recording medium so as to abut against the peripheral surface of the corresponding second roll portion 10*b* of the discharge roller 10. Thus, when the discharge guide 17 causes the abutment 17*b* to abut against the corresponding second roll portion 10*b* of the discharge roller 10 due to its own weight, the rotation of the support shaft 17*a* about its axis is stopped.

Each of the first roll portions 10*a* of the discharge roller 10 has the discharge guides 17 disposed at both sides thereof in the axial direction thereof so as to be adjacent to each other. When the leading edge of a recording medium is not introduced into both side edges of the cylindrical first roll portion 10*a*, the transport speed of the recording medium is especially apt to be slightly disturbed. This is because, when the leading edge of the recording medium abuts strongly against both side edges of the first roll portion 10*a*, the leading edge of the recording medium is likely crushed.

Since each of the discharge guides 17 is composed of a low-friction resin material such as POM, having a relatively small coefficient of friction, even when it abuts against the corresponding second roll portion 10*b* of the discharge roller 10, it does not exert an increased rotational load on the discharge roller 10.

Figure 19:
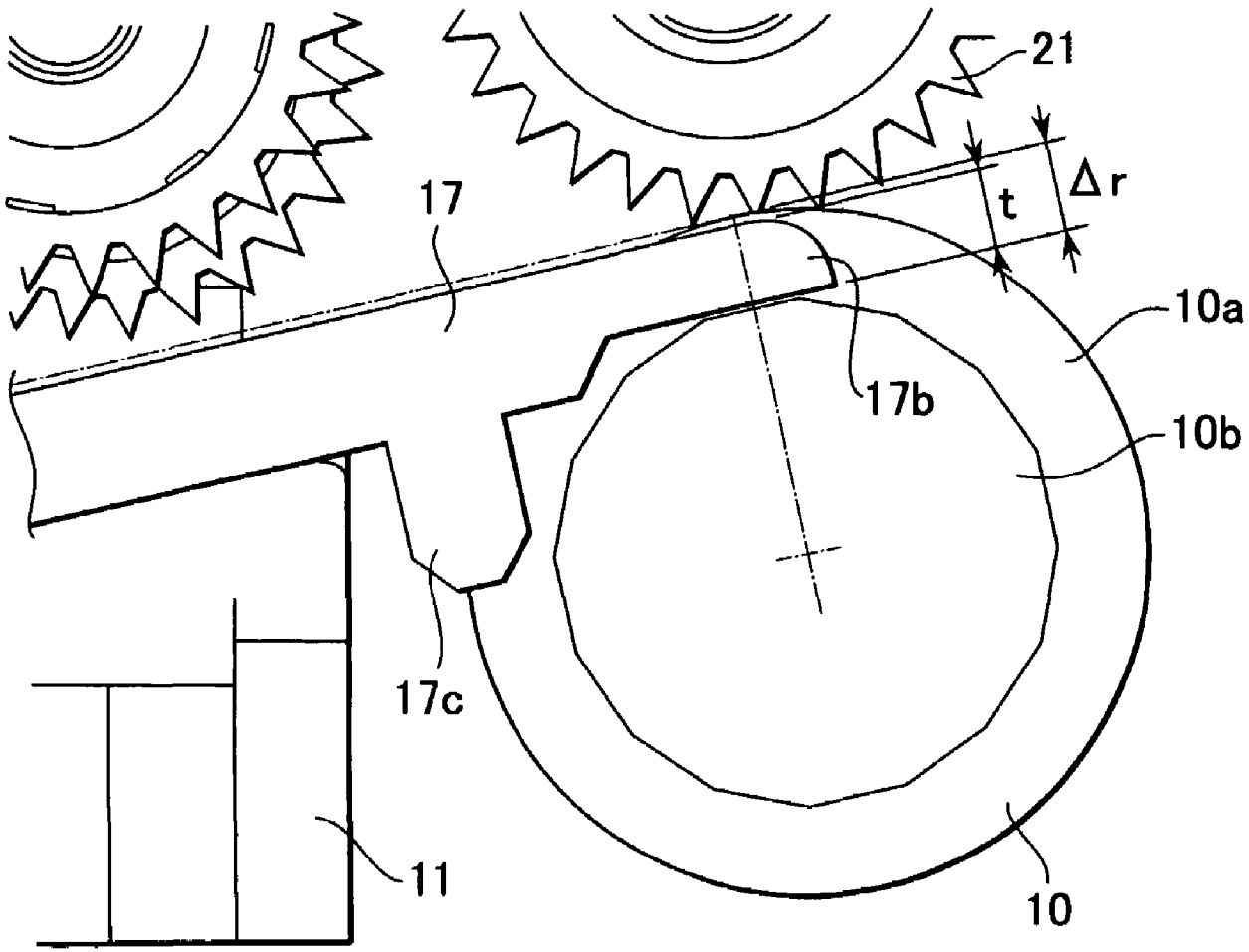
FIG. 19 is a partial sectional view of the printer, illustrating the operation of the discharge guide.
Figure 20:
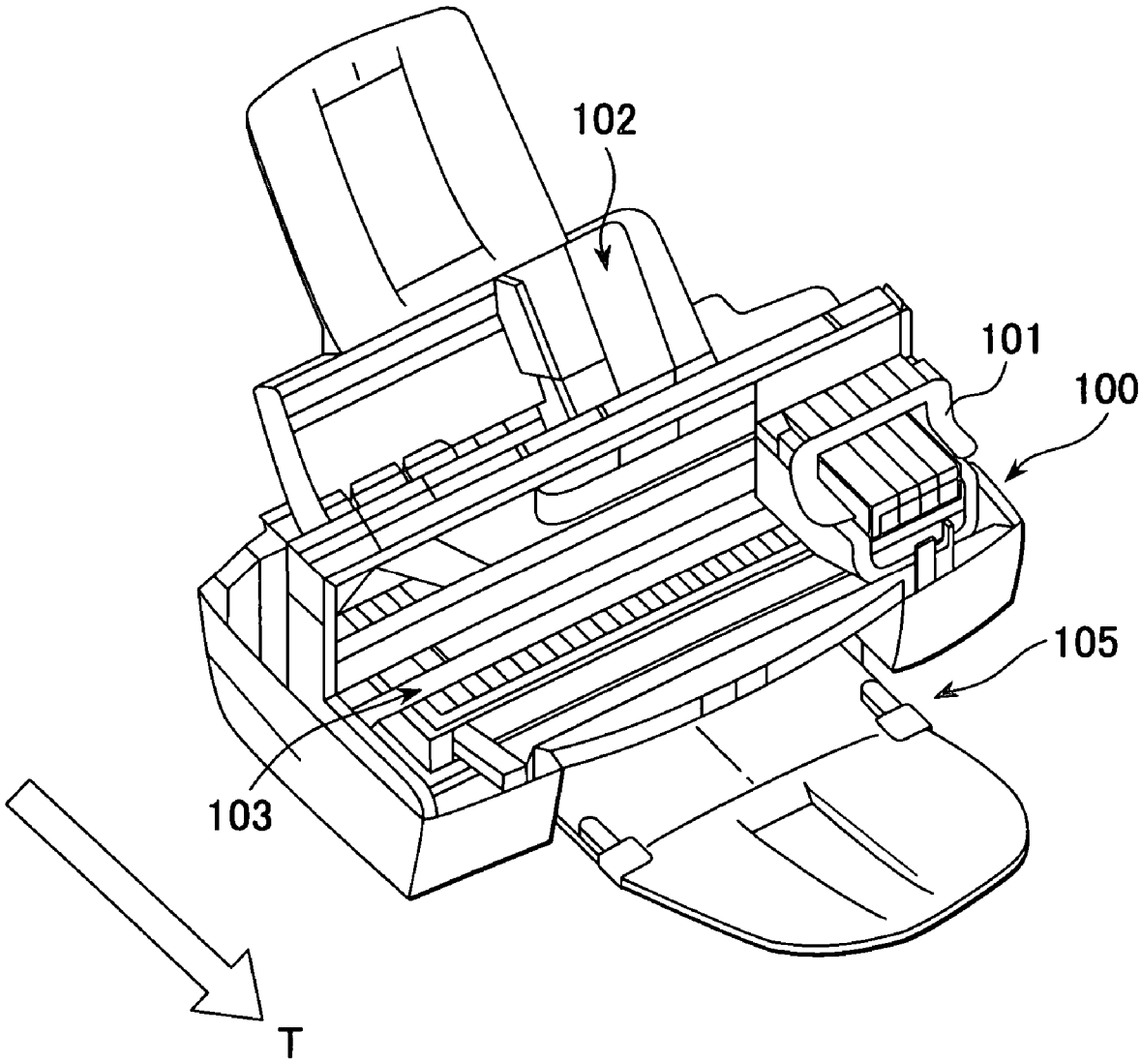
FIG. 20 PRIOR ART
FIG. 20 is a perspective view of a known inkjet printer.
Figure 21:
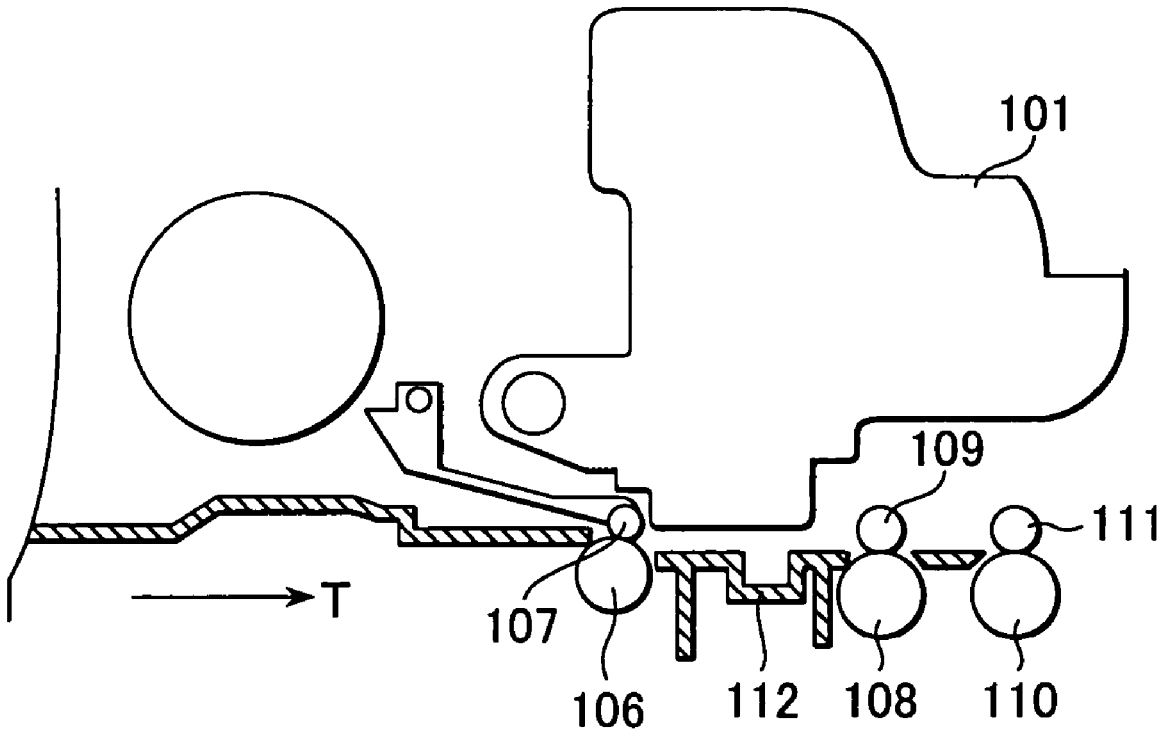
FIG. 21 is a sectional view of the known inkjet printer.
Figure 22:
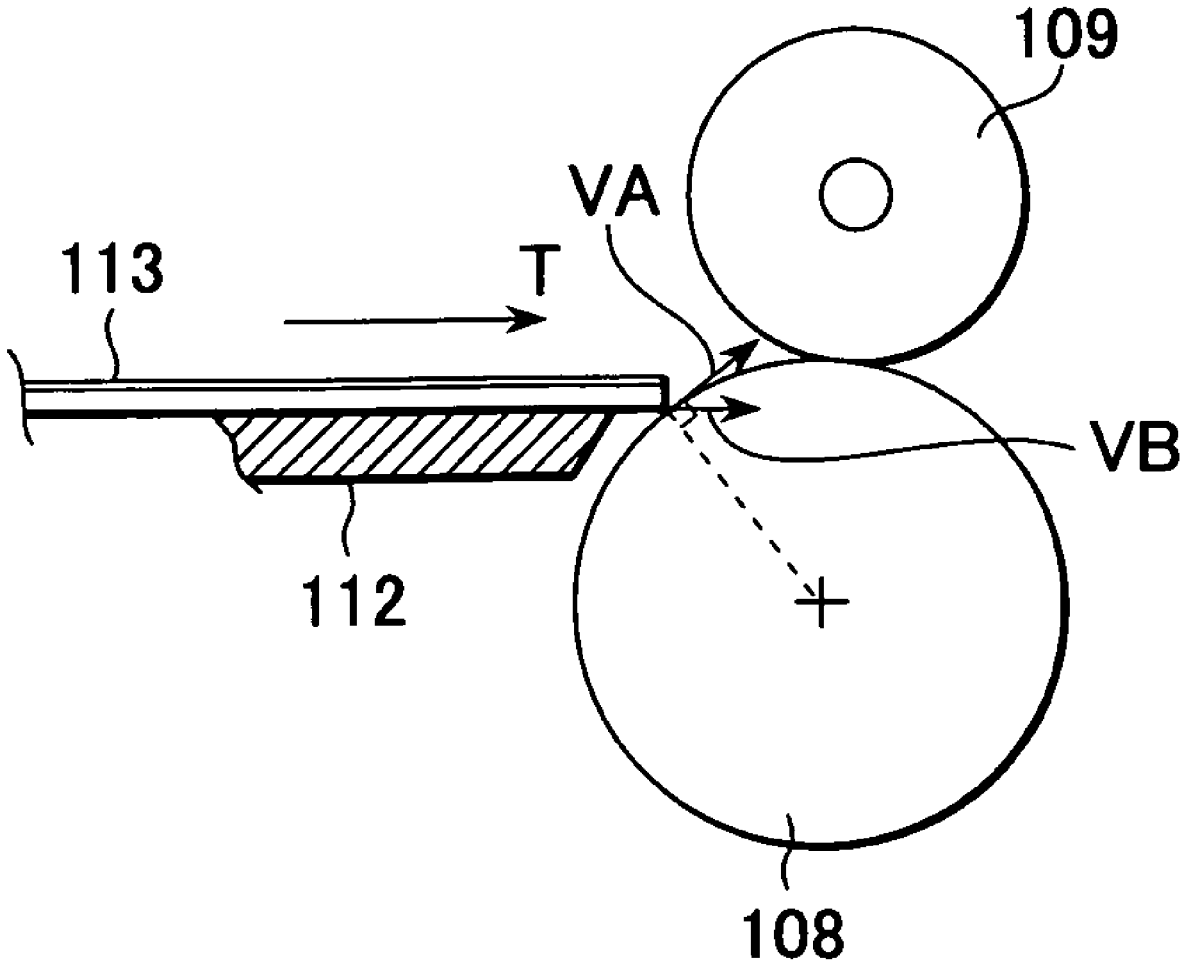
FIG. 22 PRIOR ART
FIG. 22 is a partial sectional view of the known inkjet printer, illustrating a discharge roller and other components in the vicinity thereof.

Also, as shown in FIG. 19, the discharge guide 17 is formed such that the thickness t of the abutment 17*b* abutting against the second roll portion 10*b* is smaller than a difference Ar in the radii between the first roll portion 10*a* and the second roll portion 10*b* of the discharge roller 10. Thus, the first roll portions 10*a* of the discharge roller 10 protrude slightly from the principal surfaces of the corresponding discharge guides 17 toward a transport path (sheet path) of a recording medium formed by the discharge guides 17.

Figure 17:
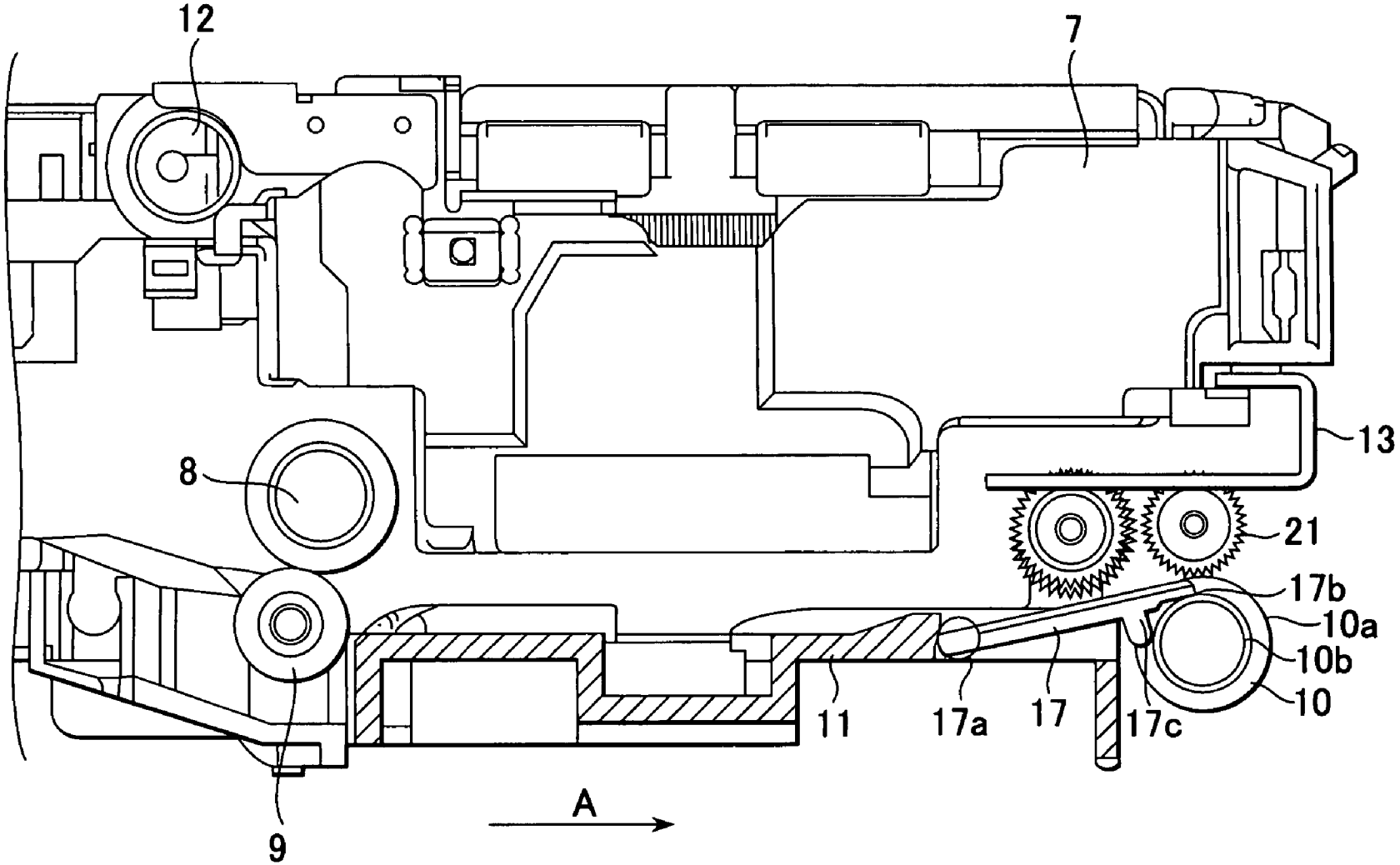
FIG. 17 is a partial sectional view of the printer, illustrating the operation of one of the discharge guides.

FIGS. 15 and 17 are partial perspective sectional views of the printer 1, illustrating the proximal and remote states in which the sheet distance is set small and large, respectively. The operation of the discharge guide 17 is easily understood by comparing FIGS. 15 and 17.

As shown in FIGS. 15 and 17, while the support shaft 17*a* of the discharge guide 17 moves as the platen 11 rotates, the abutment 17*b* lying on the opposite side of the support shaft 17*a* is maintained in a state of abutting against and being supported by the second roll portion 10*b* of the discharge roller 10.

Meanwhile, each of spurs (rotors) 21 has needle-shaped edges or spokes formed around the periphery thereof by using a thin metal plate having a thickness of, for example, about 0.1 mm to 0.3 mm. Since ink on the recording surface of a recording medium does not fully dry immediately after a recording operation, by providing the spurs 21 each with the needle-shaped edges around the periphery thereof, a contact area between the recording medium and each periphery is reduced so that the ink is prevented from being transferred.

Figure 18:
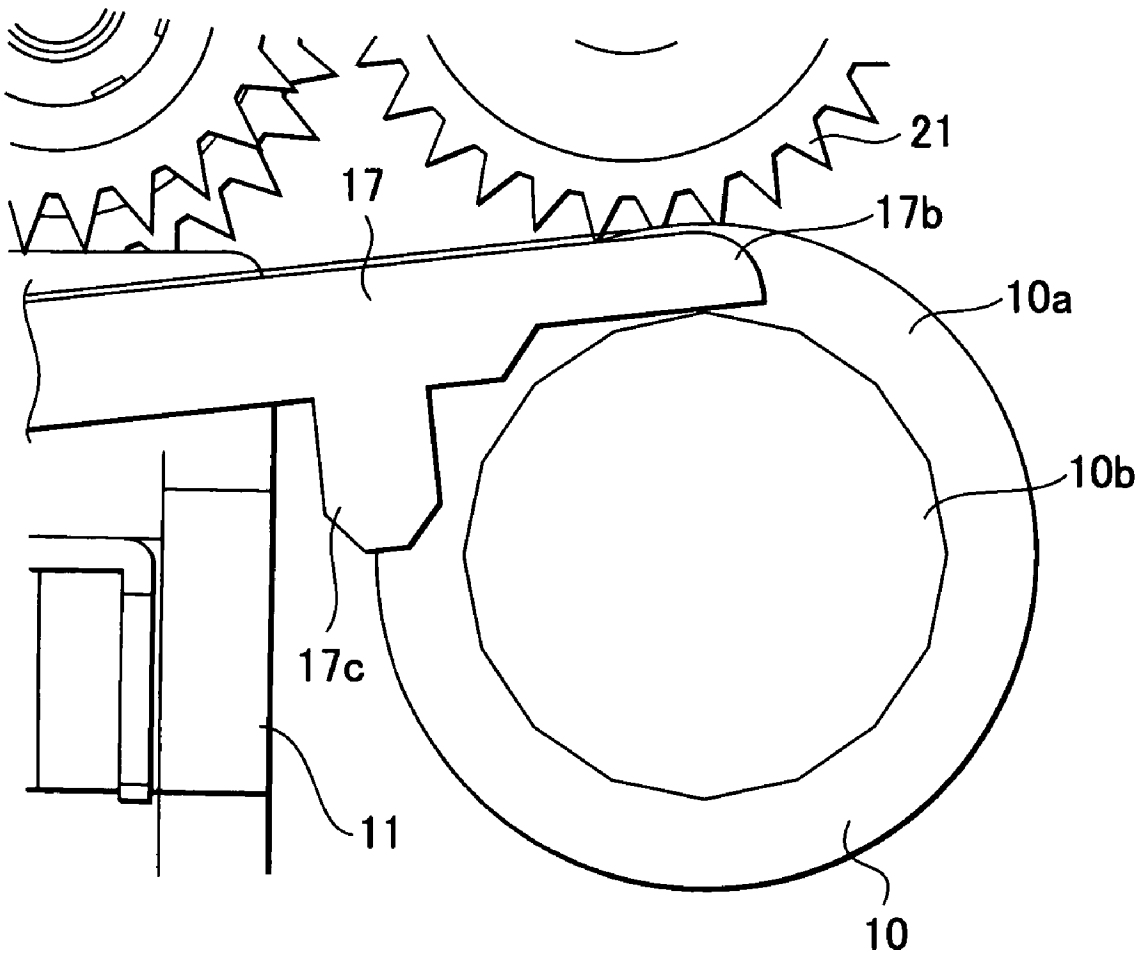
FIG. 18 is a partial sectional view of the printer, illustrating the operation of the discharge guide.

FIGS. 18 and 19 are magnified partial sectional views of the printer 1, illustrating a state in which the abutment 17*b* of the discharge guide 17 lying on the opposite side of the support shaft 17*a* of the same abuts against the corresponding second roll portion 10*b* of the discharge roller 10. FIGS. 18 and 19 respectively illustrate the proximal and remote states in which the sheet distance is set small and large.

Each of the discharge guides 17 has a guide surface so as to guide a recording medium to the contact position between the corresponding spur 21 and first roll portion 10*a* of the discharge roller 10. It is important that the first roll portion 10*a* of the discharge roller 10 is constructed so as to slightly protrude from the sheet path of the recording medium. More particularly, the guide surface of the discharge guide 17 is positioned by the corresponding second roll portion 10*b* so as to lie below the nip between the corresponding spur 21 and first roll portion 10*a*.

When the first roll portions 10*a* of the discharge roller 10 do not protrude from the sheet path, the transport capacity of the discharge roller 10 decreases drastically. On the other hand, when an amount of protrusion of the first roll portions 10 of the discharge roller 10 is great, printing irregularity occurs upon abutment of a recording medium against the first roll portions 10*a*. In addition, when the amount of protrusion of the first roll portions 10*a* is great, the orientation of a recording medium is likely disturbed upon abutment of recording medium against the first roll portions 10*a*, thereby sometimes causing a risk that the recording medium is elevated from the platen 11 and abuts against the recording head. Since the recording head has a large number of fine discharge ports for ejecting ink droplets, when the recording medium abuts against it, some of the discharge ports may be clogged, damaged, or broken in the worst case.

Also, since ink on the recording surface of a recording medium immediately after a recording operation does not fully dry, the recording medium having absorbed moisture has a reduced stiffness, whereby the above-mentioned phenomena become more pronounced. The above-mentioned reduction in stiffness due to moisture is pronounced when a recording medium such as a sheet of normal paper composed of pulpwood is used.

Since the amount of protrusion of the first roll portions 10*a* is determined by making the discharge guides 17 abut against the second roll portions 10*b* of the discharge roller 10, the amount of protrusion can be accurately controlled by controlling the dimensions of the discharge roller 10 and the discharge guides 17. Although each of the discharge guides 17 is a molded component, it can be formed within a dimensional tolerance of about ±0.03 mm. Also, with respect to the discharge roller 10, since each of the second roll portions 10*b* is formed by grinding the corresponding first roll portion 10*a*, the step between the second roll portion 10*b* and the first roll portion 10*a* can be formed within a dimensional tolerance of about ±0.01 mm.

On the other hand, if the discharge guides 17 are affixed to the platen 11 in an upside down orientation, the foregoing amount of protrusion of the first roll portions 10*a* of the discharge roller 10 protruding from the sheet path is different from a design value, whereby the foregoing effect is not achieved. As a countermeasure against this problem, each of the discharge guides 17 has a projection 17*c* integrally formed on the other surface of the principal surface thereof in order to prevent the platen 11 from being fixed upside down during assembly. That is, the discharge guide 17 has a substantially flat principal surface for guiding a recording medium and the other surface having the projection 17*c* formed thereon.

By providing the discharge guide 17 with the projection 17*c*, its front and rear surfaces can be easily recognized at a glance during the manufacturing process of the printer 1, and also, even when it is fixed upside down by mistake, a recording medium is caught on the projection 17*c* and is not discharged during the inspection process of the printer 1, whereby faulty assembly can be easily detected.

During the manufacturing process of the printer 1, the platen 11, the discharge guides 17, and the discharge roller 10 are assembled, and then the guide rail 13 is built so as to lie vertically above them. Thus, even when the overall printer 1 is turned upside down after assembly, the discharge guides 17 abut against the guide rail 13 and the turning thereof is accordingly stopped.

In the present embodiment, each of the first roll portions 10*a* of the discharge roller 10 has the discharge guides 17 disposed at both sides thereof and fourteen units of the discharge guides 17 are disposed in total in the printer 1. Although the discharge guides 17 could be integrally connected all together, when the flatness of the platen 11 and the straightness of the discharge roller 10 are taken into account, it is preferable that the discharge guides 17 operate independently of each other.

As described above, the printer 1 having the above structure is equipped with the discharge guides 17, each having one end rotatably supported by the platen 11 and the other end abutting against the corresponding second roll portion 10*b* of the discharge roller 10, thereby eliminating so-called printing irregularity occurring upon abutment of a recording medium against the first roll portions 10*a* of the discharge roller 10 and thus achieving an accurate recording operation without decreasing the transport capacity of the discharge roller 10. Accordingly, with the structure of the printer 1, the discharge guides 17 having a relatively simple structure allow a recording medium to be easily, reliably, and stably transported to the discharge roller 10.

The printer 1 according to the present invention is suitable for use in a recording apparatus in which a sheet-distance adjustment is needed, especially for use in a recording apparatus in which a sheet distance is adjusted by moving a platen.

Meanwhile, the printer 1 according to the present embodiment is mainly aimed at a portable use. Since the longitudinal length of a general flat palm of a human hand is about 70 mm to 120 mm, when ease of holding an apparatus is taken into account, the apparatus having a thickness of 60 mm or less is excellent in portability. Also, many of office desks commercially available in Europe and the United States are equipped with drawers having an inner width of 310 mm or greater, considering that letter-sized files are stored in the drawers. In view of these circumstances, the size of the printer 1 is determined so as to provide dimensions of about 51.8 mm in thickness, 310 mm in width, and 174 mm in depth, whereby it can be easily held by hand and also be stored in a drawer of an office desk.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus comprising:

a recording head performing a recording operation by discharging ink;

a platen for guiding a recording medium, disposed so as to face said recording head;

a discharge roller for discharging the recording medium, disposed downstream of said platen and comprising at least two first roller portions and at least one second roller portion having a smaller diameter than said first roller portions; and at least two guide members for guiding the recording medium from said platen to said discharge roller, wherein one end of each of said guide members is rotatably supported by said platen and the other end thereof abuts against said second roller portion of said discharge roller.

2. The recording apparatus according to claim 1, wherein each of said guide members comprises a stepped shape with the one end thereof being thicker than the other end that abuts against said second roller portion.

3. The recording apparatus according to claim 2, wherein at least one of the surface of said guide members that abuts against said second roller portion and the surface of said second roller portion is formed of a low friction material.

4. The recording apparatus according to claim 1, wherein said platen is movable to adjust a gap between said recording head and the recording medium.

5. The recording apparatus according to claim 1, further comprising rotors cooperating with said first roller portions to form nips to pinch the recording medium, wherein each of said guide members comprises a guide surface for guiding the recording medium and is positioned by said second roller portion such that the guide surface lies below the nips.

6. A recording apparatus for performing a recording operation on a recording medium with an inkjet head that discharges ink, comprising:

transporting means for transporting the recording medium;

a platen for guiding the recording medium transported by said transporting means;

holding means for holding the inkjet head so as to face said platen;

a transport roller for transporting the recording medium downstream of said platen, said transport roller comprising a first roller portion coming into contact with the recording medium and a second roller portion having a smaller diameter than said first roller portion;

a rotor cooperating with said first roller portion for sandwiching the recording medium; and a guide member, positioned by said second roller portion, for guiding the recording medium from said platen into a nip between said first roller portion and said rotor, wherein said guide member comprises an upstream positioning portion positioned by said platen and a downstream positioning portion positioned by said second roller portion.

7. The recording apparatus according to claim 6, wherein said upstream positioning portion of said guide member is rotatably supported by said platen.

8. The recording apparatus according to claim 6, wherein said downstream positioning portion of said guide member abuts against said second roller portion.

9. The recording apparatus according to claim 6, wherein said guide member is of a stepped shape with said upstream positioning portion being thicker than said downstream positioning portion.

10. The recording apparatus according to claim 6, wherein at least one of the surface of said guide member that abuts against said second roller portion and the surface of said second roller portion is formed of a low-friction material.

11. The recording apparatus according to claim 6, wherein said guide member comprises a guide surface for guiding the recording medium and is positioned by said second roller portion such that the guide surface lies below the nip.

12. The recording apparatus according to claim 6, wherein said platen is movable to adjust a gap between the inkjet head and the recording medium.

13. A recording apparatus for performing a recording operation on a recording medium with an inkjet head that discharges ink, comprising:

transporting means for transporting the recording medium;

a platen for guiding the recording medium transported by said transporting means;

holding means for holding the inkjet head so as to face said platen;

a transport roller for transporting the recording medium downstream of the platen, said transport roller comprising at least two first roller portions coming into contact with the recording medium and at least one second roller portion having a smaller diameter than said first roller portions;

at least two rotors cooperating with corresponding first roller portions for sandwiching the recording medium; and at least two guide members, supported by said second roller portion, for guiding the recording medium from said platen into a nip between said first roller portions and said corresponding rotors, wherein said platen is movably supported so as to change a distance from said platen to the inkjet head held by said holding means, and wherein each of said guide members comprises an upstream supporting portion supported by said platen and a downstream supporting portion supported by said second roller portion.

14. The recording apparatus according to claim 13, wherein said upstream supporting portion of each of said guide members is rotatably supported by said platen.

15. The recording apparatus according to claim 13, wherein said downstream supporting portion of each of said guide members abuts against said second roller portion.

16. The recording apparatus according to claim 13, wherein each of said guide members is of a stepped shape with said upstream positioning portion being thicker than said downstream positioning portion.

17. The recording apparatus according to claim 13, wherein at least one of the surface of said guide members that abuts against said second roller portion and the surface of said second roller portion is formed of a low-friction material.

18. The recording apparatus according to claim 13, wherein each of said guide members comprises a guide surface for guiding the recording medium and is supported by said second roller portion such that that guide surface lies below the nip.

* * * * *

UNITED STATES PATENT AND TRADEMARK OFFICE

CERTIFICATE OF CORRECTION

PATENT NO. : 6,986,574 B2
APPLICATION NO. : 10/762322
DATED : January 17, 2006
INVENTOR(S) : Takashi Nojima et al.

It is certified that error appears in the above-identified patent and that said Letters Patent is hereby corrected as shown below:

COLUMN 2
Line 49, "used" should read --used for--.
Line 50, "forming" should read --form--.

COLUMN 9
Line 40, "Ar" should read --Δr--.

Signed and Sealed this

Twenty-fourth Day of July, 2007

JON W. DUDAS
*Director of the United States Patent and Trademark Office*